United States Patent [19]

Sugiyama et al.

[11] 4,388,906

[45] Jun. 21, 1983

[54] FUEL INJECTED ENGINE CONTROL DEVICE AND METHOD PERFORMING WALL-ADHERED FUEL ACCOUNTING

[75] Inventors: Shinichi Sugiyama; Takayoshi Nakatomi, both of Susono, Japan

[73] Assignee: Toyota Jidosha Kabushiki Kaisha, Aichi, Japan

[21] Appl. No.: 375,196

[22] Filed: May 5, 1982

[30] Foreign Application Priority Data

Jul. 6, 1981 [JP] Japan ..... 56-105338

[51] Int. Cl.[3] ..... F02B 3/00

[52] U.S. Cl. ..... 123/492; 123/480; 123/493

[58] Field of Search ..... 123/492, 493, 480

[56] References Cited

U.S. PATENT DOCUMENTS

| | | | |
|---|---|---|---|
| 4,086,884 | 5/1978 | Moon | 123/487 |
| 4,245,605 | 1/1981 | Rice | 123/492 |
| 4,266,275 | 5/1981 | Marchak | 123/492 |
| 4,327,682 | 5/1982 | Harada | 123/492 |
| 4,357,923 | 11/1982 | Hideg | 123/492 |

*Primary Examiner*—Ronald B. Cox

*Attorney, Agent, or Firm*—Stevens, Davis, Miller & Mosher

[57] ABSTRACT

A method for controlling an internal combustion engine with a fuel injection valve fitted to its intake manifold. Repeatedly a first quantity representing the desired amount of fuel to be supplied to the combustion chambers in the next fuel injection pulse, a second quantity representing the proportion of fuel in one pulse which will adhere to the walls of the intake system, and a third quantity representing the proportion of fuel adhering to these walls which will be sucked off into the combustion chambers between two successive pulses are determined, based upon sensed values of certain operational parameters. Simultaneously, at proper injection time points in the engine's operational cycle, first from the third quantity and a fourth quantity representing the total fuel amount adhering to the walls a fifth quantity representing the actual fuel amount sucked off from the walls between two successive pulses is determined; then from the first, second, and fifth quantities a sixth quantity representing the actual fuel amount to be injected in the next pulse is determined; then from the sixth and second quantities a seventh quantity representing the actual amount of fuel from the next pulse that will adhere to the walls is determined; next the fourth quantity is updated by adding the seventh and subtracting the fifth quantity, and next the fuel injection valve is opened for a time corresponding to the sixth quantity. A device is also explained, incorporating an electronic computer, which practices this method.

18 Claims, 15 Drawing Figures

FUEL INJECTED ENGINE CONTROL DEVICE AND METHOD PERFORMING WALL-ADHERED FUEL ACCOUNTING

BACKGROUND OF THE INVENTION

The present invention relates to a control device and method for an internal combustion engine equipped with a fuel injection system; and more particularly relates to a control device, incorporating a plurality of sensors and an electronic control computer which receives signals from said sensors and which controls said fuel injection system of said internal combustion engine, said control device accurately and appropriately controlling the amount of fuel supplied by said fuel injection system during various and diverse operational conditions of the internal combustion engine so as to provide good engine operational characteristics, and to a control method for said internal combustion engine equipped with a fuel injection system, said control method being practiced by said device.

Fuel injection is becoming a more and more popular method of fuel supply to gasoline internal combustion engines of automotive vehicles nowadays. This is because of the inherently greater accuracy of metering of liquid fuel by fuel injection techniques as opposed to the metering of liquid fuel available in a carburetor type fuel supply system. In many cases the advantages obtained by this greater accuracy of fuel metering provided by a fuel injection system outweigh the disadvantage of the increased cost thereof. For example, this better fuel metering enables engine designers to produce engines with higher compression ratio and more spark advance, which can lead to increased performance characteristics, such as increased power, increased torque, and better engine elasticity.

Because a fuel injection system can accurately determine the amount of fuel to be supplied to the airfuel mixture intake system of the vehicle in a wide variety of engine operational conditions, it is possible to operate the engine in a way which generates substantially lower levels of harmful exhaust emissions such as NOx, HC, and CO; and in fact it is possible to satisfy the legal requirements for cleanliness of vehicle exhaust gases, which are becoming more and more severe nowadays, without providing any exhaust gas recirculation for the engine. This is very beneficial with regard to drivability of the engine, especially in idling operational condition. Further, because of the higher efficiency of fuel metering available, this allows leaner airfuel mixture operation of the engine with still acceptable drivability. With fuel injection provided to a vehicle type, more consistent exhaust emission results are available from vehicles coming off the assembly line at the factory, without complicated, troublesome, and expensive individual adjustments. Further, the warmup control of the vehicle is highly flexible, i.e. can be flexibly adjusted to a wide variety of engine warming up conditions, which contributes considerably to the achieved exhaust emission results.

Further, an internal combustion engine equipped with a fuel injection system can be operated in such a way as to be substantially more economical of gasoline than a carburetor type internal combustion engine. This is again because of the greater accuracy available for determination of the amount of fuel to be supplied to the intake system of the vehicle over a wide variety of engine operational conditions. Since it is possible to operate the engine at the stoichiometric air/fuel ratio, and to apply closed loop control to the fuel injection control system, it is possible to reduce the amount of spark retardation, and also the above mentioned dispensing with exhaust gas recirculation is possible, and both of these have significant beneficial effects with regard to fuel consumption. Further, with a fuel injection type fuelair mixture supply system, it is possible to cut off fuel supply entirely when the engine is operating in an overrun mode, which again results in a significantly reduced consumption of fuel. Nowadays, with the increased cost of fuel and the wider demand for fuel economical vehicles, and with legal requirements which are being introduced in some countries relating to fuel economy of automotive vehicles, these considerations are more and more becoming very important. In addition, by the introduction of a fuel injection type fuel-air mixture supply system, a engine of smaller piston displacement can replace an engine with larger piston displacement which is provided with a carburetor type fuel supply system, while providing the same output power, and again this reduces fuel consumption. By the introduction of a fuel injection type fuel-air mixture supply system, also, in many cases it is possible to switch an engine from premium grade type fuel operation to operation on lower grade or regular type fuel, while still providing the same output power, which is economical of the more expensive premium grade type fuels.

Some types of fuel injection system for internal combustion engines utilize mechanical control of the amount of injected fuel. An example of this mechanical fuel amount control type of fuel injection system is the so called K-jetronic type of fuel injection system. However, nowadays, with the rapid progress which is being attained in the field of electronic control systems, various arrangements have been proposed in which electronic control circuits make control decisions as to the amount of fuel that should be supplied to the internal combustion engine, in various engine operational conditions. Such electronic fuel injection systems are becoming much more popular, because of the more flexible way in which the fuel metering can be tailored to various different combinations of engine operational conditions. The most modern of these electronic fuel injection systems use a microcomputer such as an electronic digital computer to regulate the amount of fuel injected per one engine cycle, and it is already conventionally known to use the microcomputer also to regulate various other engine functions such as the provision of ignition sparks for the spark plugs.

In an electronic fuel injection system, the control system requires of course to know the moment by moment current values of certain operational parameters of the internal combustion engine, the amount of injected fuel being determined according to these values. The current values of these operational parameters are sensed by sensors which dispatch signals to the electronic control system via A/D converters and the like. In such an arrangement, electric signals are outputted by such an electronic control system to an electrically controlled fuel injection valve, so as to open it and close it at properly determined instants separated by proper time intervals; and this fuel injection valve is provided with a substantially constant supply of pressurized gasoline from a pressure pump. This pressurized gasoline, when the fuel injection valve is opened, and during the time of such opening, is squirted through said fuel injection valve into the intake manifold of the internal combustion engine upstream of the intake valves thereof. Thus, the amount of injected gasoline is substantially proportional to the time of opening of the fuel injection valve, less, in fact, an inoperative time required for the valve to open. Sometimes only one fuel injection valve is provided for all the cylinders of the internal combustion engine, or alternatively several fuel injection valves may be provided, up to one for each cylinder of the engine, according to design requirements.

The first generation fuel injection systems were of the so called D-jetronic type, in which the main variables monitored by the electronic fuel injection control system are the revolution speed of the internal combustion engine and the vacuum, or depression, present in the intake manifold of the internal combustion engine downstream of the throttle valve mounted at an intermediate position therein due to the suction in said intake manifold produced by the air flow passing through the intake manifold of the internal combustion engine to enter the combustion chambers thereof after being mixed with liquid fuel squirted in through the fuel injection valve or valves. From these two basic measured internal combustion engine operational parameters, a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are further measured in various implementations of the D-jetronic system and are used for performing corrections to the basic fuel injection amount.

Following this, a second generation of fuel injection systems has been developed, which is of the so called L-jetronic type, in which the main variables monitored by the electronic fuel injection control system are the revolution speed of the internal combustion engine and the amount of air flow passing through the intake manifold of the internal combustion engine to enter the combustion chambers thereof after being mixed with liquid fuel squirted in through the fuel injection valve or valves. This air flow amount is measured by an air flow meter of a design which has become developed, located at an intermediate point in the intake manifold. From these two basic measured internal combustion engine operational parameters, again a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are again further measured in various implementations of the L-jetronic system, and are used for performing corrections to the basic fuel injection amount. This L-jetronic fuel injection control system is currently well known and is nowadays fitted to a large number and variety of vehicles.

One refinement that has been made to the L-jetronic fuel injection system has been to perform a control of the fuel injection amount based upon feedback from an air/fuel ratio sensor or O2 sensor, which is fitted to the exhaust manifold of the internal combustion engine and which detects the concentration of oxygen in these exhaust gases, again in a per se well known way. This feedback control homes in on a proper amount of fuel injection, so as to provide a stoichiometric air/fuel ratio for the intake gases sucked into the cylinders of the engine, and for the exhaust gases of the engine, but the starting point region over which the homing in action of such a feedback control system is effective is limited, and therefore the determination of the approximately correct amount of fuel to be injected by the fuel injection valve is still very important, especially in the case of transient operational conditions of the engine.

One difficulty that has occurred with such normal spark ignition engines which are equipped with either the D-jetronic form of electronic fuel injection system or the L-jetronic form of electronic fuel injection system is that, if the fuel injection system calculates the amount of fuel which it is desired to inject into the combustion chambers of the engine in the next pulse of fuel injection, and then simply controls the fuel injection valve or valves in the engine air intake system so as to inject this amount of fuel into the air intake system on this next pulse, the engine will be substantially properly operated during steady operational conditions, but during acceleration or deceleration the engine will not receive the proper amount of fuel. This is because of the effect of fuel adhering to the wall surfaces of the air intake passage, and of the intake ports.

Considering this phenomenon in more detail, since in such a D-jetronic or L-jetronic fuel injection system the supply of liquid fuel is not vaporized or finely atomized as in a carburetor type fuel supply system, but is squirted directly into the air intake passage of the engine through the fuel injection valve which cannot atomize the fuel very well, therefore quite a large quantity of liquid fuel tends to accumulate in liquid form on the wall surfaces of the air intake passage and of the intake ports. Of course, also some of this liquid fuel tends to get swept off or sucked off into the combustion chambers of the engine. In completely steady state operation of the engine, these two effects, i.e. the fuel accumulation or adhering effect and the fuel sucking off effect, tend to cancel one another out. However, during rapidly changing operational conditions of the engine, these two effects by no means cancel one another out, and prior art types of fuel injection systems in which no consideration was given to the effect of adhesion of fuel on the wall surfaces of the air intake passage and of the intake ports, and the effect of sucking off of said fuel, are not able to provide proper operation of the internal combustion engine.

These two effects are illustrated respectively in FIG. 12 and FIG. 13 of the accompanying drawings, in which like reference numbers denote like parts. In these figures, the reference numeral 3 denotes the cylinder head of an internal combustion engine, the reference numeral 5 denotes a combustion chamber defined under said cylinder head 3, between said cylinder head 3 and a piston not shown in the figures, the reference numeral 6 denotes an intake port formed in said cylinder head 3, the reference numeral 8 denotes an intake valve of a poppet type which controls communication between said intake port 6 and said combustion chamber 5, the reference numeral 11 denotes the intake manifold of the engine which is clamped to said cylinder head 3, and the reference numeral 20 denotes the fuel injection valve of the engine which is fitted in said intake manifold 11. In FIG. 12 the system is shown in its operational mode in which the fuel injection valve 20 is injecting fuel in a squirt into the intake manifold 11, with the intake valve 8 closed, and as shown in this figure a substantial proportion of this liquid fuel is accumulating or adhering in a liquid layer or film on the wall surfaces of the air intake passage and of the intake port, and around the stem of the intake valve 8. On the other hand, in FIG. 13 the system is shown in its operational mode in which the fuel injection valve 20 is not injecting fuel into the intake manifold 11, and the intake valve 8 is open, and as shown in this figure a substantial proportion of the liquid fuel which has been accumulated or adhered in said liquid layer or film on the wall surfaces of the air intake passage and of the intake port, and around the stem of the intake valve 8, is being now swept or sucked off said surfaces into the combustion chamber 5 past the open intake valve 8, by the suction of the flow of air which is passing through the intake manifold 11 and past the open intake valve 8.

SUMMARY OF THE INVENTION

Thus, it has been determined by the present inventors that, in order to provide a proper control of fuel injection over a wide range of engine operational conditions, it is necessary for a fuel injection system to take account of these twin problems of the phenomenon of adhering of fuel to the wall surfaces of the air intake passage and of the intake ports, and of the phenomenon of sucking off of said fuel into the combustion chambers of the engine during the intake strokes of the engine. In this connection, the present inventors have made certain observations connected with these phenomena, as follows.

First, in the prior art type of fuel injection system in which no consideration was given to the effect of adhesion of fuel on the wall surfaces of the air intake passage and of the intake ports, and to the effect of sucking off of said fuel, when the engine was accelerated of course the throttle valve in the air intake system was opened, and together with this the amount of fuel being injected through the fuel injection valve was simultaneously increased, but because a substantial proportion of this extra injected fuel was adhered or accumulated in the liquid layer or film on the wall surfaces of the air intake passage and of the intake port, thus increasing the total volume of fuel in this liquid layer or film, thereby the air-fuel mixture actually being supplied into the combustion chambers of the internal combustion engine became over lean; in other words, a lean spike of air-fuel mixture occurred during engine acceleration. Conversely, when the engine was decelerated of course the throttle valve in the air intake system was closed, and together with this the amount of fuel being injected through the fuel injection valve was simultaneously decreased, but because the same proportion as before of the fuel adhered or accumulated in the liquid layer or film on the wall surfaces of the air intake passage and of the intake port was sucked off into the combustion chambers per one engine cycle, thus decreasing the total volume of fuel in this liquid layer or film, thereby the air-fuel mixture actually being supplied into the combustion chambers of the internal combustion engine became over rich; in other words, a rich spike of air-fuel mixture occurred during engine deceleration.

Accordingly, it is the primary object of the present invention to provide a method for controlling an internal combustion engine which is equipped with an electronic fuel injection system, and a device which implements the method, which properly take account of the quantity of fuel which is present in said liquid layer or film on the wall surfaces of the air intake passage and of the intake ports.

It is a further object of the present invention to provide such a method for controlling an internal combustion engine which is equipped with an electronic fuel injection system, and a device which implements the method, which can provide an air-fuel mixture of the proper air/fuel ratio, both during steady operation of the internal combustion engine, and during transient operational conditions thereof.

It is a further object of the present invention to provide such a method for controlling an internal combustion engine which is equipped with an electronic fuel injection system, and a device which implements the method, which can provide an air-fuel mixture of the proper air/fuel ratio, during steady operation of the internal combustion engine, during accelerating operational condition thereof, and also during decelerating operational condition thereof.

It is a further object of the present invention to provide such a method for controlling an internal combustion engine which is equipped with an electronic fuel injection system, and a device which implements the method, which can perform a correction to somewhat increase the basic fuel injection amount provided by the fuel injection system, during acceleration of the internal combustion engine when the amount of fuel which is adhered in a film to the wall surfaces of the air intake passage and of the intake ports is increasing, so as to compensate for this increase and so as to avoid a lean spike being produced in the air/fuel ratio of the air-fuel mixture delivered to the internal combustion engine.

It is a further object of the present invention to provide such a method for controlling an internal combustion engine which is equipped with an electronic fuel injection system, and a device which implements the method, which can perform a correction to somewhat decrease the basic fuel injection amount provided by the fuel injection system, during deceleration of the internal combustion engine when the amount of fuel which is adhered in a film to the wall surfaces of the air intake passage and of the intake ports is decreasing, so as to compensate for this decrease and so as to avoid a rich spike being produced in the air/fuel ratio of the air-fuel mixture delivered to the internal combustion engine.

In order to achieve these objects, and others, the present inventors have carried out various experimental researches relative to the behavior of fuel, both in its adhering to the wall surfaces of the air intake passage and of the intake ports, and in its being sucked off from said wall surfaces by the air flowing therepast, so as to enter into the combustion chambers of the engine. Some of the results of these experimental researches may be summarized as follows. The amount of fuel out of one pulse of fuel injection provided through the fuel injection valve which adheres to the wall surfaces of the air intake passage and of the intake ports, so as to be added to the cumulative amount of fuel already there, is, other things being equal, roughly proportional to the total amount of fuel in said fuel injection pulse; in other words, substantially the same proportion of the injected fuel tends to adhere to said wall surfaces, irrespective of the actual amount of injected fuel. The proportionality constant relative to this adhesion, however, tends to vary with variation of, in particular, the following quantities: air intake manifold pressure or depression, engine cooling water temperature, engine revolution speed, and air flow speed in the air intake manifold. As a matter of fact, said proportionality constant varies, to a lesser extent, with intake passage wall temperature and intake air temperature and atmospheric pressure. Further, the absolute amount of fuel out of the total or cumulative amount of fuel which is adhering to the wall surfaces of the air intake passage and of the intake ports which is sucked off into the combustion chambers of the internal combustion engine is, other things being equal, roughly proportional to said total or cumulative amount of fuel adhering to the wall surfaces of the air intake passage and of the intake ports; in other words, substantially the same proportion of the fuel adhering to the wall surfaces tends to be sucked off, irrespective of the actual amount of adhering fuel. The proportionality constant relative to this sucking off, however, again tends to vary with variation of the following quantities: air intake manifold pressure or depression, engine cooling water temperature, engine revolution speed, and air flow speed in the air intake manifold. Again, as a matter of fact, said proportionality constant varies, to a lesser extent, with intake passage wall temperature and intake air temperature and atmospheric pressure. Further details of these experimental researches performed by the present inventors with respect to these proportionality constants will be found later in the section of this specification entitled DESCRIPTION OF THE PREFERRED EMBODIMENT.

Therefore, it is a further object of the present invention to provide such a method for controlling an internal combustion engine which is equipped with an electronic fuel injection system, and a device which implements the method, which can properly take account of the quantity of fuel which is present in said liquid layer or film on the wall surfaces of the air intake passage and of the intake ports, while allowing for variation of air intake manifold pressure.

It is a further object of the present invention to provide such a method for controlling an internal combustion engine which is equiped with an electronic fuel injection system, and a device which implements the method, which can properly take account of the quantity of fuel which is present in said liquid layer or film on the wall surfaces of the air intake passage and of the intake ports, while allowing for variation of engine cooling water temperature.

It is a further object of the present invention to provide such a method for controlling an internal combustion engine which is equipped with an electronic fuel injection system, and a device which implements the method, which can properly take account of the quantity of fuel which is present in said liquid layer or film on the wall surfaces of the air intake passage and of the intake ports, while allowing for variation of engine revolution speed.

It is a further object of the present invention to provide such a method for controlling an internal combustion engine which is equipped with an electronic fuel injection system, and a device which implements the method, which can properly take account of the quantity of fuel which is present in said liquid layer or film on the wall surfaces of the air intake passage and of the intake ports, while allowing for variation of air flow speed in the air intake manifold.

Of course, the provision of any special sensor for detecting the actual amount of adhered fuel on the wall surfaces of the air intake passage and of the intake ports is not practicable: such a sensor, even if it could be made, would be costly, difficult to make and install and service, and prone to breakdown during use.

Therefore, it is yet a further object of the present invention to provide such a method for controlling an internal combustion engine which is equipped with an electronic fuel injection system, and a device which implements the method, which do not require any special sensor for detecting the actual amount of adhered fuel on the wall surfaces of the air intake passage and of the intake ports.

It is yet a further object of the present invention to provide such a method for controlling an internal combustion engine which is equipped with an electronic fuel injection system, and a device which implements the method, which are not prone to breakdown during use.

It is yet a further object of the present invention to provide such a method for controlling an internal combustion engine which is equipped with an electronic fuel injection system, and a device which implements the method, which do not involve undue expense in manufacture of the fuel injection system.

It is yet a further object of the present invention to provide such a method for controlling an internal combustion engine which is equipped with an electronic fuel injection system, and a device which implements the method, which do not involve undue difficulty in manufacture of the fuel injection system.

It is yet a further object of the present invention to provide such a method for controlling an internal combustion engine which is equipped with an electronic fuel injection system, and a device which implements the method, which do not involve undue difficulty in maintenance of the fuel injection system.

According to the most general method aspect of the present invention, these and other objects are accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine; (b) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (c) at time points in said operational cycle of said internal combustion engine and said fuel injection valve which are proper fuel injection time points, performing the following processes in the specified order: (c1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (c2) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse; (c3) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system; (c4) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (c5) modifying said actuating signal according to the value of said sixth quantity representing the actual fuel amount to be injected through said fuel injection valve in the next fuel injection pulse; and (c6) supplying said modified actuating signal to said fuel injection valve in such a fashion as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold; wherein the method used in subprocess (c2) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

According to such a method, account is kept of the total amount of fuel adhering to the wall surfaces of the air-fuel mixture intake system, by performing the calculations detailed above; and according thereto the amount of fuel actually injected into said air-fuel mixture intake system through said fuel injection valve is adjusted, so as to ensure that approximately the correct amount of fuel actually reaches the combustion chamber system of the internal combustion engine. Thus, occurrence of the aforementioned undesirable lean spike during engine acceleration, and occurrence of the aforementioned rich spike during engine deceleration, are effectively prevented.

Further, according to a more restricted method aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine; (b) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (c) at time points in said operational cycle of said internal combustion engine and said fuel injection valve which are proper fuel injection time points, performing the following processes in the specified order: (c1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and, if according to the current operational conditions of said internal combustion engine it is proper to inject fuel through said fuel injection valve, (c2) performing the following processes in the specified order: (c2.1) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse; (c2.2) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system; (c2.3) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (c2.4) modifying said actuating signal according to the value of said sixth quantity representing the actual fuel amount to be injected through said fuel injection valve in the next fuel injection pulse; and (c2.5) supplying said modified actuating signal to said fuel injection valve in such a fashion as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold; but otherwise, if according to the current operational conditions of said internal combustion engine it is not proper to inject fuel through said fuel injection valve, (c3) performing the following process: (c3.1) updating the value of said fourth quantity representing the total amount of fuel adhering to said walls of said air-fuel mixture intake system by subtracting therefrom the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; wherein the method used in subprocess (c2.1) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

According to such a method, account is kept of the total amount of fuel adhering to the wall surfaces of the air-fuel mixture intake system, by performing the calculations detailed above, both during the operational conditions when fuel injection is being performed into said air-fuel mixture intake system, and also during the operational conditions when fuel injection into said air-fuel mixture intake system is being cut off; and according thereto the amount of fuel actually injected into said air-fuel mixture intake system through said fuel injection valve is adjusted, so as to ensure that approximately the correct amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned undesirable lean spike during engine acceleration, and occurrence of the aforementioned rich spike during engine deceleration, are effectively prevented.

Further, according to a more particular method aspect of the present invention, these and other objects are more particularly and concretely accomplished by an engine control method of any single one of the kinds described above, wherein the method used for calculating the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fourth quantity representing the total amount of fuel adhering to said walls of said air-fuel mixture intake system by the value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses.

According to such a method, said fifth value representing the amount of fuel from the total amount of fuel adhering to said walls of said air-fuel mixture intake system which will be sucked off therefrom is calculated simply and yet effectively. It has been shown by the present inventors, by the aforementioned process of experiment, that this method of calculation is adequate for predicting the value of the sucked off amount of fuel.

Further, according to another more particular method aspect of the present invention, these and other objects are more particularly and concretely accomplished by an engine control method of any single one of the kinds described above, wherein the method used for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion egine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

According to such a method, said sixth value representing the actual fuel amount to be injected through said fuel injection valve in the next fuel injection pulse is calculated simply and yet effectively, by a formula which will be explained in detail in the portion of this specification entitled DESCRIPTION OF THE PREFERRED EMBODIMENT. It has been shown by the present inventors, by the aforementioned process of experiment, that this method of calculation is adequate for predicting the value of the sucked off amount of fuel.

Further, according to yet another more particular method aspect of the present invention, these and other objects are more particularly and concretely accomplished by an engine control method of any single one of the kinds described above, wherein the method used for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

According to such a method, said seventh quantity representing the amount of fuel from the next fuel injection pulse that will adhere to said walls of said air-fuel mixture intake system is calculated simply and yet effectively. It has been shown by the present inventors, by the aforementioned process of experiment, that this method of calculation is adequate for predicting the value of the sucked off amount of fuel.

Further, according to the most general device aspect of the present invention, these and other objects are accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors, which sense the current values of certain operational parameters of said internal combustion engine; (b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine; (d) said electronic computer repeatedly and alternatingly and/or simultaneously: (d1) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d2) at time points in said operational cycle of said internal combustion engine and said fuel injection valve which are proper fuel injection time points, performing the following processes in the specified order: (d2.1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d2.2) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse; (d2.3) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system; (d2.4) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and (d2.5) outputting to said interface device a fuel injection valve control electrical signal, based upon the value of said sixth quantity representing the actual fuel amount to be injected through said fuel injection valve in the next fuel injection pulse, such as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold; wherein the method used by said electronic computer in subprocess (d2.2) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

According to such a structure, said electronic computer keeps account of the total amount of fuel adhering to the wall surfaces of the air-fuel mixture intake system, by performing the calculations detailed above; and according thereto the amount of fuel actually injected into said air-fuel mixture intake system through said fuel injection valve is adjusted by said electronic computer, so as to ensure that approximately the correct amount of fuel actually reaches the combustion chamber system of the internal combustion engine. Thus, occurrence of the aforementioned undesirable lean spite during engine acceleration, and occurrence of the aforementioned rich spike during engine deceleration, are effectively prevented.

Further, according to a more restricted device aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors, which sense the current values of certain operational parameters of said internal combustion engine; (b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine; (d) said electronic computer repeatedly and alternatingly and/or simultaneously: (d1) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d2) at time points in said operational cycle of said internal combustion engine and said fuel injection valve which are proper fuel injection time points, performing the following processes in the specified order: (d2.1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and, if according to the current operational conditions of said internal combustion engine it is proper to inject fuel through said fuel injection valve, (d2.2) performing the following processes in the specified order: (d2.2.1) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse; (d2.2.2) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system; (d2.2.3) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d2.2.4) midifying said actuating signal according to the value of said sixth quantity representing the actual fuel amount to be injected through said fuel injection valve in the next fuel injection pulse; and (d2.2.5) outputting to said interface device a fuel injection valve control electrical signal, based upon the value of said sixth quantity representing the actual fuel amount to be injected through said fuel injection valve in the next fuel injection pulse, such as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold; but otherwise, if according to the current operational conditions of said internal combustion engine it is not proper to inject fuel through said fuel injection valve, (d2.3) performing the following process: (d2.3.1) updating the value of said fourth quantity representing the total amount of fuel adhering to said walls of said air-fuel mixture intake system by subtracting therefrom the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; wherein the method used by said electronic computer in subprocess (d2.2.1) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

According to such a structure, said electronic computer keeps account of the total amount of fuel adhering to the wall surfaces of the air-fuel mixture intake system, by performing the calculations detailed above, both during the operational conditions when fuel injection is being performed into said air-fuel mixture intake system, and also during the operational conditions when fuel injection into said air-fuel mixture intake system is being cut off; and according thereto the amount of fuel actually injected into said air-fuel mixture intake system through said fuel injection valve is adjusted by said electronic computer, so as to ensure that approximately the current amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned undesirable lean spike during engine acceleration, and occurrence of the aforementioned rich spike during engine deceleration, are effectively prevented.

Further, according to a more particular device aspect of the present invention, these and other objects are more particularly and concretely accomplished by either one of the engine control devices described above, wherein the method used by said electronic computer for calculating the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fourth quantity representing the total amount of fuel adhering to said walls of said air-fuel mixture intake system by the value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses.

According to such a structure, said electronic control computer calculates said fifth value representing the amount of fuel from the total amount of fuel adhering to said walls of said air-fuel mixture intake system which will be sucked off therefrom simply and yet effectively. It has been shown by the present inventors, by the aforementioned process of experiment, that this method of calculation is adequate for predicting the value of the sucked off amount of fuel.

Further, according to another more particular device aspect of the present invention, these and other objects are more particularly and concretely accomplished by any single one of the engine control devices described above, wherein the method used by said electronic computer for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

According to such a structure, said electronic control computer calculates said sixth value representing the actual fuel amount to be injected through said fuel injection valve in the next fuel injection pulse simply and yet effectively, by a formula which will be explained in detail in the portion of this specification entitled DESCRIPTION OF THE PREFERRED EMBODIMENT. It has been shown by the present inventors, by the aforementioned process of experiment, that this method of calculation is adequate for predicting the value of the sucked off amount of fuel.

Further, according to yet another more particular device aspect of the present invention, these and other objects are more particularly and concretely accomplished by any single one of the engine control devices described above, wherein the method used by said electronic computer for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

According to such a structure, said electronic control computer calculates said seventh quantity representing the amount of fuel from the next fuel injection pulse that will adhere to said walls of said air-fuel mixture intake system simply and yet effectively. It has been shown by the present inventors, by the aforementioned process of experiment, that this method of calculation is adequate for predicting the value of the sucked off amount of fuel.

BRIEF DESCRIPTION OF THE DRAWINGS

The present invention will now be shown and described with reference to a preferred embodiment of both the method and the device thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Now, the present invention will be explained with respect to the preferred embodiment thereof, and with reference to the accompanying drawings.

Figure 1:
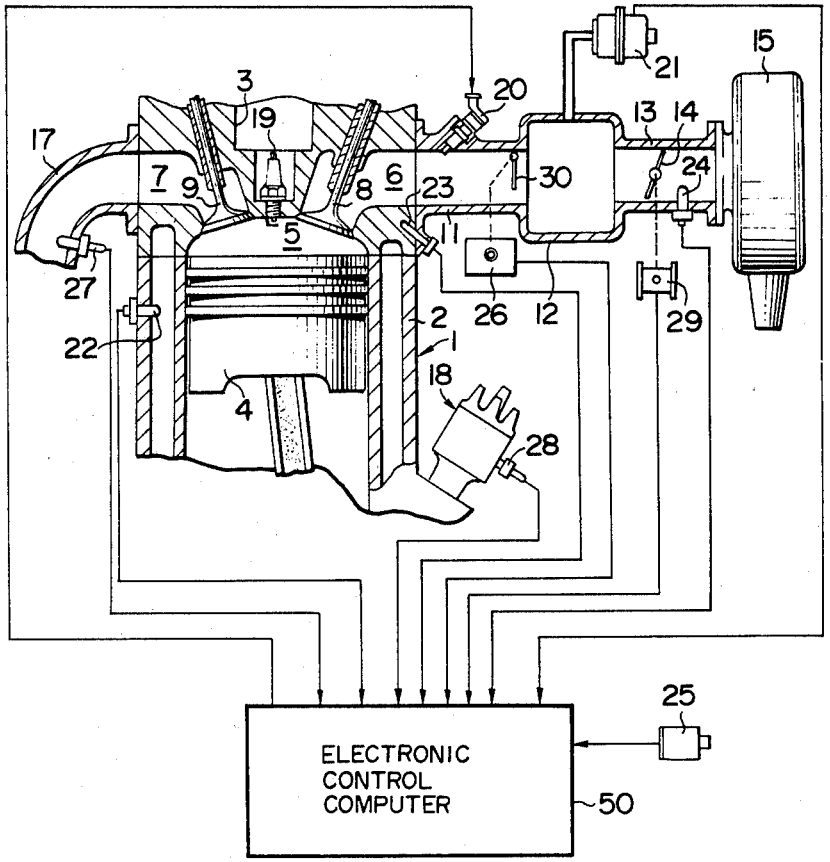
FIG. 1 is a partly schematic partly cross sectional drawing, diagrammatically showing an example of an internal combustion engine which is equipped with a fuel injection system and which is suitable to be controlled by an embodiment of the engine control device according to the present invention, said fuel injection system being of the D-jetronic type incorporating an intake manifold pressure sensor, according to an embodiment of the engine control method of the present invention; this figure also showing in schematic part block diagram form the preferred embodiment of the engine control device according to the present invention, which practices the preferred embodiment of the engine control method according to the present invention, and which controls said internal combustion engine.
Figure 12:
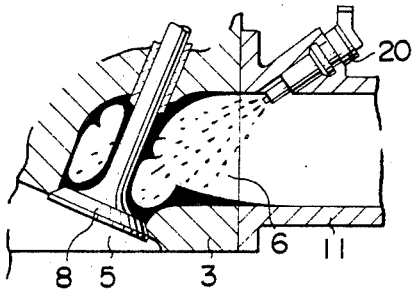
FIG. 12 is a part sectional part perspective view, showing part of the internal combustion engine including an intake port, an intake valve, and a combustion chamber thereof in its operational mode in which a fuel injection valve is injecting fuel in a squirt into an intake manifold with the intake valve closed, and showing that a substantial proportion of this liquid fuel is accumulating or adhering in a liquid layer or film on the wall surfaces of the air intake passage and of the intake port and around the stem of the intake valve.
Figure 13:
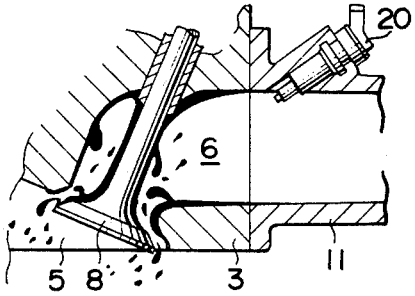
FIG. 13 is a part sectional part perspective view, similar to FIG. 12, showing the same part of the internal combustion engine in its operational mode in which the fuel injection valve is not injecting fuel into the intake manifold and the intake valve is open, and showing that a substantial proportion of the liquid fuel which has been accumulated or adhered in said liquid layer or film on the wall surfaces of the air intake passage and of the intake port and around the stem of the intake valve is being now swept or sucked off said surfaces into the combustion chamber past the open intake valve by the suction of the flow of air which is passing through the intake manifold and past the open intake valve.

In FIG. 1 there is shown a part schematic part cross sectional diagram of an internal combustion engine, generally designated by the reference numeral 1, which is a fuel injection type of engine comprising a fuel injection system which is per se well known, and which is controlled according to the preferred embodiment of the engine control method according to the present invention by the preferred embodiment of the engine control device according to the present invention, as will henceforth be explained.

The internal combustion engine 1 comprises a conventional type of cylinder block 2, within which are formed a plurality of cylinder bores, only one of which can be seen in the drawing. To the top ends of the cylinder bores remote from the crankshaft of the internal combustion engine 1, i.e. to the upper end of the cylinder bore as seen in the figure, there is fitted a cylinder head 3, and within each of the bores there reciprocates a piston 4 in a per se well known way. Thus, the bores, the top surfaces of the pistons 4, and the bottom surface of the cylinder head 3 cooperate in a per se well known way to form a plurality of combustion chambers 5, only one of which, again, can be seen in the drawing.

Each of the combustion chambers 5 is provided with an intake port 6 and an exhaust port 7, and these ports 6 and 7 are each respectively controlled by one of a plurality of intake valves 8 or one of a plurality of exhaust valves 9. Further, spark ignition is provided for each combustion chamber 5 by one of a plurality of spark plugs 19, each of which is provided at appropriate times with high tension electrical energy from an ignition coil not shown in the figures via a distributor 18, so as to cause said spark plug 19 to spark, in a per se well known way.

To the exhaust ports 7 of the internal combustion engine 1 there is connected an exhaust manifold 17 which leads the exhaust gases of the engine from the combustion chambers 5 to an exhaust pipe, not shown in the figures, and at an intermediate part of this exhaust pipe there is fitted a three way catalytic converter, in the case of this particular internal combustion engine 1, although this three way catalytic converter is not shown in the figures either. To the intake ports 6 of the internal combustion engine 1 there is connected an intake manifold 11 which leads to an intake air surge tank 12. To this surge tank 12 there is connected a throttle body 13, to which there communicates an air cleaner 15. Thus, air flows in from the atmosphere through, in order, the air cleaner 15, the throttle body 13, the surge tank 12, and the intake manifold 11, to enter into the combustion chambers 5 of the internal combustion engine 1, when sucked in through the intake ports 6 by the pistons 4 as they move downwards as seen in the figure on their intake strokes.

To an intermediate part of the intake manifold 11 there is fitted a fuel injection valve 20 of a per se well known electrically controlled sort. This fuel injection valve 20 is supplied with pressurized liquid fuel such as gasoline from a fuel tank, not shown in the figures, by a fuel pump also not shown in the figures and also of a per se well known sort, and the opening and closing of this fuel injection valve 20 are electrically controlled by an electronic control computer 50 which will hereinafter be described, which forms part of the preferred embodiment of the engine control device according to the present invention, which functions according to the preferred embodiment of the engine control method according to the present invention. Thus, according to the duration of the interval of time between said opening of said fuel injection valve 20 and said closing of said fuel injection valve 20, the amount of liquid fuel such as gasoline injected into the intake manifold 11 per one cycle of operation of said fuel injection valve 20 can be regulated.

A throttle valve 14 which in this shown internal combustion engine 1 is a butterfly type throttle valve is mounted at an intermediate point in the through passage in the throttle body 13 so as to control its air flow resistance, i.e. the effective cross section of said passage, and this throttle valve 14 is controlled by a linkage which is not shown in the figures according to the amount of depression of a throttle pedal also not shown in the figures provided by actuating movement of the foot of the driver of the vehicle which is powered by this internal combustion engine 1.

This completes the description of the parts of the internal combustion engine 1, and of the associated systems thereof, and of the fuel injection system of the internal combustion engine 1, which are controlled according to the aforesaid preferred embodiment of the engine control method according to the present invention by the preferred embodiment of the engine control device according to the present invention. This engine control device comprises a plurality of sensors (nine, in fact) which will now be described, and also comprises an electronic control computer 50 which may be a microcomputer, and which will be described shortly with respect to its architecture and its mode of operation. Together, these sensors furnish signals which convey information to the electronic control computer 50 relating to operational conditions of the internal combustion engine 1, and based upon this information about engine operational conditions the electronic control computer 50 dispatches electrical signals to the fuel injection valve 20 so as appropriately to operate and control the internal combustion engine 1, according to the aforesaid preferred embodiment of the engine control method according to the present invention.

These signals are: (1) an air intake passage pressure signal which is generated by a vacuum sensor 21 which senses the pressure in the surge tank 12; (2) a crank angle and engine revolution speed signal which is generated by a revolution sensor 28 fitted to the distributor 18; (3) an intake air temperature signal generated by an intake air temperature sensor 24 which is fitted in the throttle body 13 upstream of the throttle valve 14; (4) a cooling water temperature signal generated by a cooling water temperature sensor 22 which is attached to the cylinder block 2 in order to to sense the temperature of the cooling water within the water jacket thereof; (5) an excess air signal generated by an O2 sensor 27 of a per se well known sort which is fitted to the exhaust manifold 17 and which generates said excess air signal which is representative of the air/fuel ratio of the exhaust gases of the internal combustion engine 1 which are being exhausted through said exhaust manifold 17; (6) a intake port wall temperature signal generated by an intake port wall temperature sensor 23 which is attached to the cylinder block 2 is close proximity to the wall of one of the intake ports 6 in order to sense the temperature of said intake port wall; (7) a throttle idling signal which is produced by a throttle idling limit switch 29 which is coupled to the movement of said throttle valve 14 or to the movement of said linkage, not particularly shown, which drives said throttle valve 14, said throttle idling limit switch 29 indicating by its output signal whether the throttle valve 14 is in its fully closed or idling position or not; (8) an atmospheric pressure signal generated by an atmospheric air pressure sensor 25; and (9) an intake air flow amount or rate signal which is generated by an intake air flow amount or rate sensor 26 incorporated in an intake air flow rate or amount meter which includes a flapper 30 which is mounted in the intake manifold 11 downstream of the surge tank 12.

Figure 2:
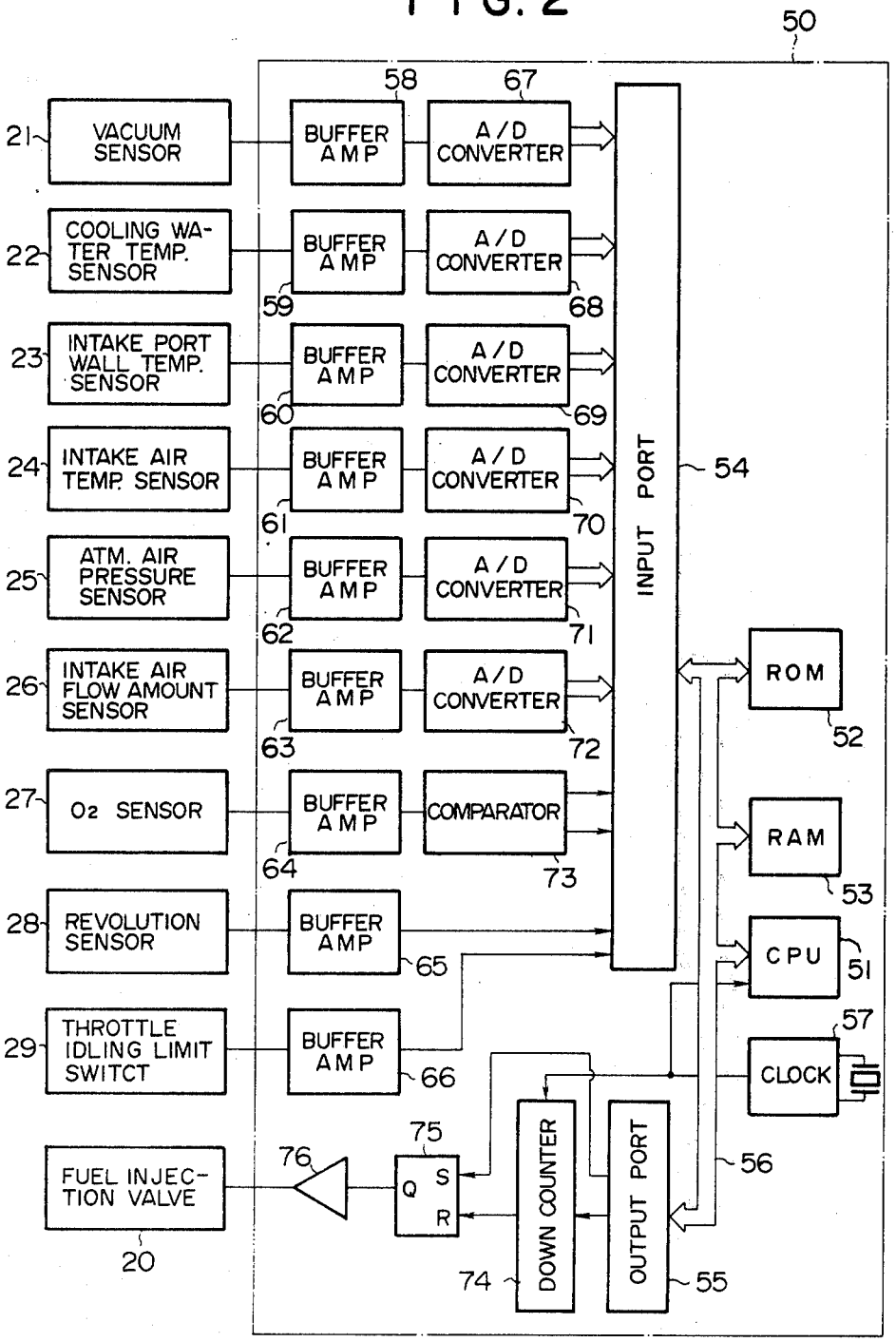
FIG. 2 is a more detailed block diagram, showing the preferred embodiment of the control device according to the present invention for controlling the engine shown in FIG. 1 in more detail with regard to the internal construction of an electronic computer incorporated therein, and also showing parts of said internal combustion engine, also in block diagrammatical form.

The general large scale internal architecture of the electronic control computer 50 is shown in FIG. 2. The control computer 50 comprises: a central processing unit or CPU 51; a read only memory or ROM 52; a random access memory or RAM 53; an input port 54; and an output port 55. All of these parts are mutually interconnected by a common bus 56. The CPU 51 is provided with a clock signal from a clock pulse signal generator 57 of a per se well known sort.

The air intake passage pressure signal which is generated by the vacuum sensor 21 which senses the pressure in the surge tank 12 is sent via a buffer amplifier 58 to an analog to digital converter or A/D converter 67 of a per se well known sort in the electronic fuel injection art. The crank angle and engine revolution speed signal which is generated by the aforementioned revolution sensor 28 fitted to the distributor 18 is sent to a buffer amplifier 65. The intake air temperature signal generated by the intake air temperature sensor 24 which is fitted in the throttle body 13 upstream of the throttle valve 14 is sent via a buffer amplifier 61 to an analog to digital converter or A/D converter 70 of a per se well known sort in the art. The cooling water temperature signal generated by the cooling water temperature sensor 22 which is attached to the cylinder block 2 in order to to sense the temperature of the cooling water within the water jacket thereof is sent via a buffer amplifier 59 to an analog to digital converter or A/D converter 68 of a per se well known sort in the art. The excess air signal generated by the O2 sensor 27 which is fitted to the exhaust manifold 17 in order to detect the air/fuel ratio of the exhaust gases of the internal combustion engine 1 which are being exhausted through said exhaust manifold 17 is sent via a buffer amplifier 64 to a comparator 73 of a per se well known sort in the art. The intake port wall temperature signal generated by the intake port wall temperature sensor 23 which is attached to the cylinder block 2 in close proximity to the wall of one of the intake ports 6 in order to sense the temperature of said intake port wall is sent via a buffer amplifier 60 to an analog to digital converter or A/D converter 69 of a per se well known sort in the art. The throttle idling signal which is produced by the throttle idling limit switch 29 which is coupled to the movement of said throttle valve 14 or to the movement of said linkage, not particularly shown, which drives said throttle valve 14 is sent to a buffer amplifier 66. The atmospheric pressure signal generated by the atmospheric air pressure sensor 25 is sent via a buffer amplifier 62 to an analog to digital converter or A/D converter 71 of a per se well known sort in the art. Finally, the intake air flow amount or rate signal which is generated by the intake air flow amount or rate sensor 26 incorporated in the intake air flow rate or amount meter including the flapper 30 mounted in the intake manifold 11 downstream of the surge tank 12 is sent via a buffer amplifier 63 to an analog to digital converter or A/D converter 72 of a per se well known sort in the art.

The A/D converter 67 converts the analog value of the air intake passage pressure signal which is generated by the vacuum sensor 21 and which is amplified by and dispatched from the buffer amplifier 58 into a digital value representative thereof, at an appropriate timing under the control of the CPU 51, and feeds this digital value to the input port 54 which supplies said value to the CPU 51 and/or the RAM 53, as appropriate, again at an appropriate timing under the control of the CPU 51. The A/D converter 68 converts the analog value of the cooling water temperature signal which is generated by the cooling water temperature sensor 22 attached to the cylinder block 2 and which is amplified by and dispatched from the buffer amplifier 59 into a digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51. The A/D converter 69 converts the analog value of the intake port wall temperature signal which is generated by the intake port wall temperature sensor 23 attached to the cylinder block 2 in close proximity to the wall of one of the intake ports 6 and which is amplified by and dispatched from the buffer amplifier 60 into a digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51. The A/D converter 70 converts the analog value of the intake air temperature signal which is generated by the intake air temperature sensor 24 fitted in the throttle body 13 upstream of the throttle valve 14 and which is amplified by and dispatched from the buffer amplifier 61 into a digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51. The A/D converter 71 converts the analog value of the atmospheric pressure signal which is generated by the atmospheric air pressure sensor 25 and which is amplified by and dispatched from the buffer amplifier 62 into a digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51. The A/D converter 72 converts the analog value of the intake air flow amount or rate signal which is generated by the intake air flow amount or rate sensor 26 incorporated in the intake air flow rate or amount meter including the flapper 30 mounted in the intake manifold 11 downstream of the surge tank 12 and which is amplified by and dispatched from the buffer amplifier 63 into a digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51.

Further, the comparator 73 compares the value of the excess air signal which is generated by the O2 sensor 27 fitted to the exhaust manifold 17 and which is amplified by and dispatched from the buffer amplifier 64 with a standard value indicative roughly of stoichiometric condition of the exhaust gases in said exhaust manifold 17, produces a binary digital value representative thereof, again at an appropriate timing under the control of the CPU 51, and feeds this digital value to the input port 54 which supplies said value to the CPU 51 and/or the RAM 53, as appropriate, again at an appropriate timing under the control of the CPU 51. The crank angle and engine revolution speed signal which is generated by the aforementioned revolution sensor 28 fitted to the distributor 18 and which is amplified by and dispatched from the buffer amplifier 65, which is already a binary digital value, is fed directly to the input port 54 which supplies said value to the CPU 51 and/or the RAM 53, as appropriate, again at an appropriate timing under the control of the CPU 51. Finally, the throttle idling signal which is generated by the throttle idling limit switch 29 which is coupled to the movement of said throttle valve 14 or to the movement of said linkage which drives said throttle valve 14, which also is already a binary digital value, is similarly fed directly to the input port 54 which supplies said value to the CPU 51 and/or the RAM 53, as appropriate, again at an appropriate timing under the control of the CPU 51. The details of these analog to digital conversions, and of these input processes, described above, based upon the disclosure in this specification, will be easily filled in by one of ordinary skill in the computer programming art.

The CPU 51 operates as will hereinafter be more particularly described, according to a control program stored in the ROM 52, on these digital data values and others, and from time to time, i.e. whenever it is the proper timing instant to start injecting a pulse of gasoline through the fuel injection valve 20 into the intake manifold 11, produces a digital output signal whose magnitude is representative of the desired magnitude of said fuel injection pulse, said digital output signal being fed to the output port 55. This output port 55 supplies this output signal in digital form to a fuel injection valve control system, which comprises a down counter 74, a flipflop 75, and an amplifier 76.

The fuel injection valve control system processes this signal from the output port 55 representative of fuel injection amount when said signal is received, immediately at this time outputs a control electrical signal to the fuel injection valve 20 to open said fuel injection valve 20, and at a proper time later outputs a control electrical signal to said fuel injection valve so as to close said fuel injection valve 20 again, after a fuel injection pulse of said desired magnitude has been injected through said fuel injection valve 20. In more detail, when the signal representative of fuel injection amount is output by the output port 55, this signal is supplied to the SET terminal of the flipflop 75, so as to cause the output of said flipflop 75 to be energized, said output of said flipflop 75 being then amplified by the amplifier 76 and being supplied to the fuel injection valve 20 so as to open it. The signal representative of fuel injection amount output by the output port 55 is also supplied to the down counter 74, which is thus set to the value of said signal representative of the amount of fuel to be injected when said signal is supplied by the CPU 51 of the electronic computer 50. The down counter 74 then subsequently counts down from this value according to the clock signal supplied by the clock pulse signal generator 57. Further, in this arrangement, when the value in the down counter 74 reaches zero, then the down counter 74 outputs a pulse to the RESET terminal of the flipflop 75, and this pulse thus RESETs the flipflop and causes its output to cease to be energized, so as thereby to close the fuel injection valve 20 so as to terminate the supply of liquid fuel through the fuel injection valve 20 into the intake manifold 11 of the internal combustion engine 1. By this arrangement, the duration of the pulse of injected liquid fuel is made to be proportional to the signal value outputted by the CPU 51 through the output port 55, and the time instant of the start of the opening period of the fuel injection valve 20 is substantially coincident with the time instant of dispatch of said signal from the CPU 51 to the output port 55.

A summary of the way of operation of the electronic control computer 50, which causes the preferred embodiment of the engine control method according to the present invention to be practiced by the preferred embodiment of the engine control device according to the present invention, will now be given. By the way, it should be first understood that in the control program of this electronic control computer 50 amounts of fuel to be injected through the fuel injection valve 20 are measured in time units of opening of said fuel injection valve 20, since the pressure of the supply of liquid fuel to the fuel injection valve 20 is essentially constant and hence these concepts are interchangeable for calculation purposes, if suitably interconverted by constant factors, which may be conveniently arranged to be unity. Thus, in the following discussions, times of opening of the fuel injection valve 20 and amounts of fuel to be injected therethrough will be spoken of without particular distinction between them.

A main routine of the electronic control computer 50, which will be detailed later with reference to the flow chart of FIG. 3 which is a flow chart of said main routine, is executed in a repetitive cycle whenever the ignition circuit of the automotive vehicle incorporating the internal combustion engine 1 is switched on. This main routine loops from its end to substantially its beginning, and one execution of the loop of this main routine takes about three milliseconds, which corresponds, when the crankshaft of the internal combustion engine is rotating at a typical speed of roughly 4000 rpm, to approximately 72° of crank angle.

In more detail, this main routine calculates the appropriate value for the amount of fuel to be supplied to the combustion chambers 5 of the internal combustion engine 1 for each engine fuel injection operational cycle (which, according to engine design, may correspond to one crankshaft revolution through a total angle of 360°, two crankshaft revolutions through a total angle of 720°, or some other value), repeatedly, according to the current or latest values of detected engine operational parameters which said main routine inputs, i.e. of: (1) air intake passage pressure as sensed by the vacuum sensor 21; (2) intake air temperature as sensed by the intake air temperature sensor 24 fitted in the throttle body 13; (3) engine cooling water temperature as sensed by the cooling water temperature sensor 22 attached to the cylinder block 2; (4) excess air as sensed by the O2 sensor 27; (5) intake port wall temperature as sensed by the intake port wall temperature sensor 23 attached to the cylinder block 2; (6) throttle idling condition as sensed by the throttle idling limit switch 29; (7) atmospheric pressure as sensed by the atmospheric air pressure sensor 25; and (8) intake air flow amount or rate as sensed by the intake air flow amount of rate sensor 26. Derivation of the current value of the engine revolution speed N is not performed in this input process, but is performed in an interrupt routine, to be described shortly. In detail, according to the functioning of the shown preferred embodiment of the engine control device according to the present invention, which practices the preferred embodiment of the engine control method according to the present invention, a basic amount BF of fuel to be supplied to the combustion chambers 5 is calculated from the current values of air intake passage pressure and engine revolution speed, according to the basic and per se well known principle of the D-jetronic fuel injection control system, and then this basic amount BF of fuel to be supplied is corrected first according to the value of intake air temperature and atmospheric pressure and optionally also then according to other engine operational parameters, and secondly according to the value of the excess air signal dispatched from the oxygen sensor 27, so as to cause the air/fuel ratio of the exhaust gases in the exhaust manifold 17 to home in on the stoichiometric value by a feedback process as already explained in outline in the portion of this specification entitled BACKGROUND OF THE INVENTION. Thus a desired amount of fuel DFC to be supplied into the combustion chambers 5 of the internal combustion engine 1 is calculated.

The other and very important function of this main routine that it performs is to calculate two coefficients, AWC or the wall adhere coefficient, and SOC or the sucking off coefficient, in a fashion that will be more particularly described later, according to the current values of air intake manifold pressure or depression, engine cooling water temperature, engine revolution speed, and air flow speed in the air intake manifold. These two coefficients will be used in the interrupt routine which will shortly be described. In fact, the wall adhere coefficient AWC is used for determining the amount of fuel that will adhere to the liquid fuel layer already present on the wall surfaces of the intake manifold and of the intake ports, out of the total amount of fuel which will be injected through the fuel injection valve 20; and the sucking off coefficient SOC is used for determining the amount of fuel that has been sucked off from said liquid fuel layer already present on the wall surfaces of the intake manifold and of the intake ports, out of the total amount of fuel which was present in said layer, between the time of the last pulse of fuel injection through the fuel injection valve 20, and the next such pulse. Then, after these calculations, the main routine of the electronic control computer 50 whose flow chart is shown in FIG. 3 loops back to substantially its beginning, to repeat this cycle of input and calculation.

Figure 4:
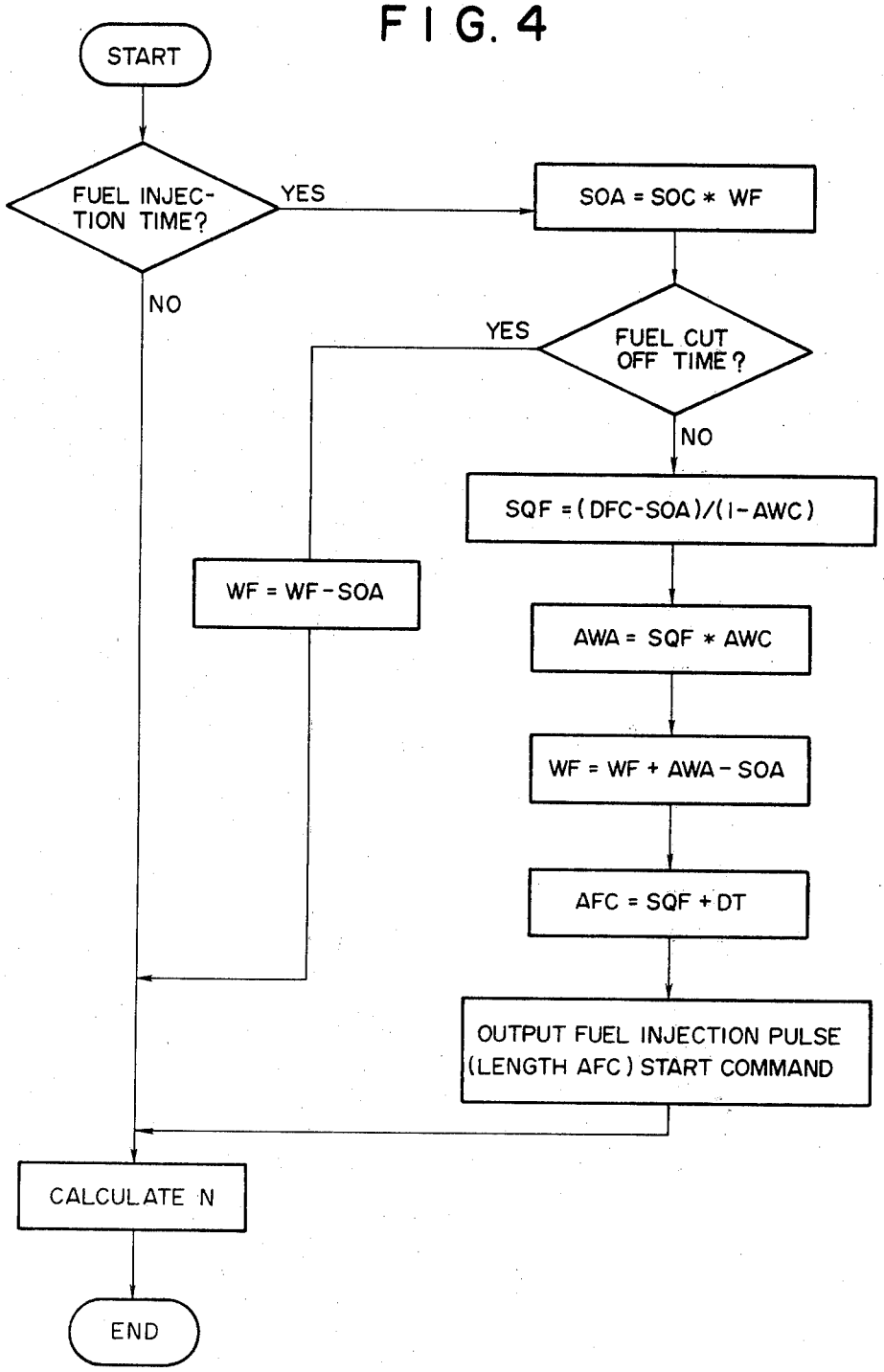
FIG. 4 is another flow chart, showing the overall flow of an interrupt routine which is executed repeatedly, according to an interrupt signal which is dispatched by a crank angle sensor, once every time the crankshaft of the engine rotates through an angle of 120° (for example), during the operation of said electronic computer which is incorporated in the preferred embodiment of the engine control device according to the present invention shown in FIGS. 1 and 2 while said engine control device is practicing the preferred embodiment of the engine control method according to the present invention.

An interrupt routine of the electronic control computer 50, which will be detailed later with reference to the flow chart of FIG. 4, is executed whenever an interrupt signal is sent to the electronic control computer 50 from the distributor 18 by the crank angle sensor 28, which occurs at every 120°, for example, of crank angle rotation. In this interrupt routine, first, a decision is made as to whether at this particular interrupt instant it is the correct time to inject a pulse of liquid fuel into the inlet manifold 11 through the fuel injection valve 20, or not. If not, the interrupt routine skips and goes to its last stage. If, on the other hand, it is now the proper time to inject fuel, then the interrupt routine must handle two jobs. First, it must perform and update a predictive calculation of the amount of fuel WF that is adhering to the wall surfaces of the intake manifold and of the intake ports, and based upon this updated prediction it must decide on the correct amount of fuel injection SQF to be provided through the fuel injection valve 20 into the intake manifold which will be suitable for supplying the actual amount DFC of fuel desired to be introduced into the combustion chambers of the internal combustion engine 1, taking into account the fact that some of this amount SQF of injected fuel will be added to the layer of liquid fuel adhering to the wall surfaces (of amount WF), and that some of this layer of liquid fuel of amount WF will be sucked off into the combustion chambers by the air flow through the intake manifold. Second, if fuel injection is not currently being cut off, the interrupt routine must actually output a command, via the output port 55, to cause this amount SQF of fuel to be injected through the fuel injection valve 20. In fact, this first calculation job is slightly more difficult than has been simplistically outlined above, because the actual amount AWA of fuel which adheres to the layer of liquid fuel adhering to the wall surfaces (of amount WF), out of the total amount SQF of fuel injected through the fuel injection valve, in fact depends upon the amount SQF of fuel injected; and thus WF in fact also reciprocally depends on SQF, as well as SQF being calculated from WF as detailed above. Hence the calculation has to be performed in a reverse manner, to take account of this mutual dependence, as will be more clearly explained later in the detailed explanation of the flow chart of this interrupt routine shown in FIG. 4.

Thus, if it is fuel injection time, first the interrupt routine makes a decision as to whether the present time is a so called fuel cut off time; in other words, as to whether the present time is a time of deceleration of the internal combustion engine 1 with the throttle valve 14 substantially fully closed, at which time it is proper to completely cease injection of liquid fuel through the fuel injection nozzle 20, in order to obtain maximum fuel economy of the internal combustion engine 1 during operation, and good quality of the exhaust gases of the internal combustion engine 1, as is per se well known with regard to the operation of various fuel injection systems. If it is not thus at the present time proper to cut off the fuel supply, then in order to derive the final result required, which is the value of a variable AFC which is the actual time that it is proper to order the fuel injection valve 20 to be opened, the interrupt routine performs the following calculations. First, the amount SOA of fuel that has been sucked off the wall surfaces of the intake manifold and the intake ports since the last fuel injection time instant is calculated, as being equal to the above detailed sucking off coefficient SOC multiplied by the actual amount WF of fuel that was adhering to the wall surfaces. Next, from the already known value of the desired amount DFC of fuel to be supplied to the combustion chambers 5 of the internal combustion engine 1, and from the already known values of the wall adhering coefficient AWC and the sucked off fuel amount SOA, (all of these values having been determined as explained above during the operation of the main routine whose flow chart is shown in FIG. 3), and using the formula $SQF=(DFC-SOA)/(1-AWC)$ which as will be explained later is appropriate in view of the reciprocal or mutual dependency of WF and SQF as outlined above, the amount of fuel to be squirted in through the fuel injection valve 20 is calculated by the interrupt routine. From this value SQF of the amount of fuel to be injected, the value AWA of the amount of fuel out of this injected amount that will adhere to the wall surfaces of the intake manifold and the intake ports is calculated as being equal to the above detailed wall adhere coefficient AWC multiplied by the actual amount SQF of fuel that is to be injected, and as is obviously correct the new value of the amount WF of fuel adhering to the wall surfaces is calculated as being equal to the old value of WF, plus AWA the adhere to the wall surfaces amount, minus SOA the sucked off fuel amount. Finally, the interrupt routine calculates the length of time AFC that the fuel injection valve 20 is to be opened as being equal to the amount SQF of fuel that is to be injected in through this fuel injection valve 20, plus a so called dead time DT for the fuel injection valve 20, and then outputs to the output port 55 this value AFC as a signal whose digital value is representative of the length of time that the fuel injection valve 20 is to be commanded to be opened. This signal as explained above, via the down counter 74, the flipflop 75, and the amplifier 76, controls the fuel injection valve 20 to inject a pulse of gasoline and to be open for a time duration corresponding to the value AFC of this signal, starting immediately. Then finally, after this injection of a pulse of liquid fuel of amount SQF (or not, as the case may have been, according to the fuel cut off situation), just before its termination point, the interrupt routine calculates the latest value of N, the engine revolution speed, from the crank angle signal generated by the engine revolution sensor 28 fitted to the distributor 18, and from readings taken from a real time clock, a timer, or the like.

If, on the other hand, it is proper at the present time to cut off injected fuel supply, then this interrupt routine need not consider any contribution to the amount WF of fuel adhering to the walls of the intake passage and the intake ports from fuel injected through the fuel injection valve 20, since no fuel is to be injected; and also of course no question arises of outputting any command via the output port 55 to control the fuel injection valve 20. Thus, in this case, the interrupt routine merely calculates the amount SOA of fuel that has been sucked off the walls during the time between the last fuel injection pulse time and this fuel injection pulse time (at least this fuel injection pulse of course being a so called phantom fuel injection pulse, i.e. a fuel injection pulse injection of which is not actually made due to fuel cut off), and subtracts this amount SOA from the previous amount WF of fuel adhering to the wall surfaces so as to obtain the new or current value WF of fuel adhering to the wall surfaces, and then proceeds to its conclusion, wherein as before it calculates the latest value of N, the engine revolution speed, from the crank angle signal generated by the engine revolution sensor 28 fitted to the distributor 18.

Figure 3:
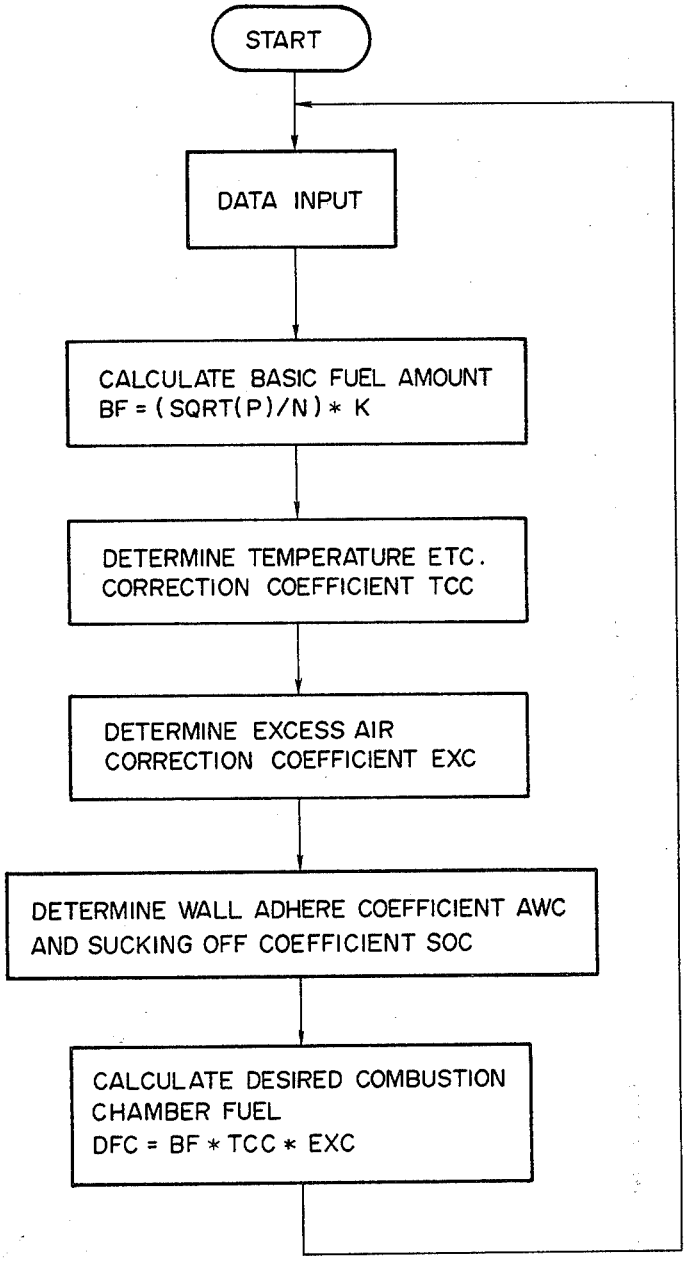
FIG. 3 is a flow chart, showing the overall control flow of a main routine which is repeatedly executed at a cycle time of about three milliseconds during the operation of said electronic computer which is incorporated in the preferred embodiment of the engine control device according to the present invention shown in FIGS. 1 and 2 while said engine control device is practicing the preferred embodiment of the engine control method according to the present invention.

Although it is not particularly shown or explained in the flow charts of FIGS. 3 and 4, because it is not directly relevant to the present invention, the electronic control computer 50 also from time to time outputs a signal to the ignition coil of the internal combustion engine 1, again via an output device of a per se well known sort, so as to cause the ignition coil to produce an ignition spark at the appropriate time. The details of this particular function of the electronic control computer 50, again, will not particularly be described here because it is per se well known and conventional. Of course, the electronic control computer 50 could also perform various other control functions for the internal combustion engine 1, simultaneously in a time shared fashion; these of course are not shown particularly either.

Now the way of operation of the electronic control computer 50 will be explained in detail, with respect to the control computer program stored therein, which causes the preferred embodiment of the engine control method according to the present invention to be practiced by the preferred embodiment of the engine control device according to the present invention. This explanation will be made with the aid of two flow charts of the control program stored therein, which are shown in FIGS. 3 and 4. In fact the actual control computer program of the electronic control computer 50 is written in a computer language, and an understanding of its intimate details is not necessary for understanding the principle of the present invention; many variations could be made without departing from the spirit of the present invention, and accordingly no more detail will be given of the computer program of the electronic control computer 50 in this preferred embodiment of the present invention than will be required by a person skilled in the art, who will be well able to fill in all the omitted detail if he or she requires to do so, based upon the disclosure contained herein.

GLOSSARY OF TERMS AND VARIABLES

In the following explanation, the values of various variables will be inputted to the RAM 53 of the electronic control computer 50, and the values of various other variables will be calculated. Thus, in order to make the following explanation clearer, the mnemonic names used herein to denote these variables will now be listed, along with a description of the function which the variables serve:

P: the air intake passage Pressure as sensed by the vacuum sensor 21;

N: the engine revolution speed as calculated by the interrupt routine whose flow chart is shown in FIG. 4;

K: a suitable constant;

BF: the Basic amount of Fuel to be supplied into the combustion chambers 5 of the internal combustion engine 1, uncorrected for factors such as temperature, etc.;

EXC: the Correction for the basic amount of fuel to be supplied into the combustion chambers 5 to allow for the amount of EXcess air in the exhaust manifold 17 as sensed by the O2 sensor 27;

TCC: the Correction Coefficient for the basic amount of fuel to be supplied into the combustion chambers 5 to allow for various factors such as intake air Temperature and atmospheric pressure and optionally other engine operational parameters;

DFC: the Desired amount of Fuel to be supplied into the Combustion chambers 5 of the internal combustion engine 1 by the next pulse of fuel injection through the fuel injection valve 20;

WF: the total or cumulative amount of Fuel which is currently adhering to the Wall surfaces of the intake manifold 11 and the intake ports 6;

AWC: the Adhere to the Wall Coefficient, i.e. the proportion of the fuel injected through the fuel injection valve 20 in the next fuel injection pulse which will adhere to the wall surfaces of the intake manifold 11 and the intake ports 6;

AWA: the Adhere to the Wall Amount, i.e. the actual amount of the fuel injected through the fuel injection valve 20 in the next fuel injection pulse which will adhere to the wall surfaces of the intake manifold 11 and the intake ports 6;

SOC: the Sucking Off Coefficient, i.e. the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5;

SOA: the Sucking Off Amount, i.e. the actual amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5;

SQF: the actual amount of Fuel Squirted in through the fuel injection valve 20 for this fuel injection pulse;

AFC: the time that the Fuel injection valve 20 is Actually Commanded by the CPU 51 to be opened;

DT: the Dead Time during which the fuel injection valve 20 is commanded to be opened by the CPU 51 but lags and does not actually inject fuel;

BAWC: the Basic value of the Adhere to the Wall Coefficient, i.e. the basic value of the proportion of the fuel injected through the fuel injection valve 20 in the next fuel injection pulse which will adhere to the wall surfaces of the intake manifold 11 and the intake ports 6, as initially determined solely by reference to intake manifold pressure without any consideration of other engine operational parameters;

BSOC: the Basic value of the Sucking Off Coefficient, i.e. the basic value of the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5, as initially determined solely by reference to intake manifold pressure without any consideration of other engine operational parameters;

AWW: a correction factor for the Adhere to the Wall Coefficient AWC based upon the current value of engine cooling Water temperature as sensed by the cooling water temperature sensor 22 attached to the cylinder block 2;

SOW: a correction factor for the Sucking Off Coefficient SOC based upon the current value of engine cooling Water temperature as sensed by the cooling water temperature sensor 22 attached to the cylinder block 2;

AWN: a correction factor for the Adhere to the Wall Coefficient AWC based upon the current value of engine revolution speed N as sensed by the revolution sensor 28 fitted to the distributor 18;

SON: a correction factor for the Sucking Off Coefficient SOC based upon the current value of engine revolution speed N as sensed by the revolution sensor 28 fitted to the distributor 18;

AWF: a correction factor for the Adhere to the Wall Coefficient AWC based upon the current value of intake air Flow amount or rate as sensed by the intake air flow amount or rate sensor 26; and SOF: a correction factor for the Sucking Off Coefficient SOC based upon the current value of intake air Flow amount or rate as sensed by the intake air flow amount or rate sensor 26.

EXPLANATION OF THE MAIN ROUTINE FLOW CHART OF FIG. 3

FIG. 3 is a flow chart, showing the overall flow of a main routine which is repeatedly executed at a cycle time of about three milliseconds during the operation of the electronic control computer 50.

The flow of control of the electronic control computer 50 starts in the START block, when the internal combustion engine 1 is started up and the ignition circuit thereof is switched on, and in this START block the various flags and other variables of the program are initialized, as will be partially detailed later in this specification, when necessary for understanding. In particular the initial value of WF, the total or cumulative amount of fuel which is currently adhering to the wall surfaces of the intake manifold 11 and the intake ports 6, is set to zero, as is of course proper. Then the flow of control passes to enter next the DATA INPUT block.

In the DATA INPUT block, which is also the block back to which the flow of control returns at the end of the main routine which is being described, data is read into the electronic control computer 50, via the input port 54 and the buffer amplifiers 58-66 (except 65) and the A/D converters 67-72 and the comparator 73, relating to the current or latest values of the following engine operational parameters: (1) air intake passage pressure P as sensed by the vacuum sensor 21; (2) intake air temperature as sensed by the intake air temperature sensor 24 fitted in the throttle body 13; (3) engine cooling water temperature as sensed by the cooling water temperature sensor 22 attached to the cylinder block 2; (4) excess air as sensed by the O2 sensor 27; (5) intake port wall temperature as sensed by the intake port wall temperature sensor 23 attached to the cylinder block 2; (6) throttle idling condition as sensed by the throttle idling limit switch 29; (7) atmospheric pressure as sensed by the atmospheric air pressure sensor 25; and (8) intake air flow amount or rate as sensed by the intake air flow amount or rate sensor 26. As will be seen later in the description of the flow chart of FIG. 4, which is the aforementioned interrupt routine which is performed every time the crankshaft of the internal combustion engine rotates by, for example, 120°, the calculation of the current value of the engine revolution speed N is performed in that interrupt routine, according to the crank angle and engine revolution speed signal which is generated by the aforementioned revolution sensor 28 fitted to the distributor 18 as input via the buffer amplifier 65 and the input port 54 and supplied to the electronic control computer 50; so this signal from the revolution sensor 28 is not processed in this DATA INPUT block. After the electronic computer 50 has performed the data input functions described above, the flow of control passes to enter next the CALCULATE BASIC FUEL AMOUNT BF=(SQRT(P)/N)*K block.

In the CALCULATE BASIC FUEL AMOUNT BF=(SQRT(P)/N)*K block, the basic amount of fuel to be supplied into the combustion chambers 5 of the internal combustion engine 1 is calculated from the current value of P, which is the air intake passage pressure as sensed by the vacuum sensor 21 and as converted by the A/D converter 67 and supplied to the electronic control computer 50, and from the current value of N, which is the current value of engine revolution speed as calculated by the interrupt routine shown in FIG. 4, as will be explained later. This calculation is performed according to the formula, per se well known in the art with relation to this D-jetronic system method of fuel injection, of BF=(SQRT(P)/N)*K, where the symbol K represents a suitable constant, and where the symbol BF represents the basic amount of fuel to be supplied into the combustion chambers 5 of the internal combustion engine 1, uncorrected for factors such as temperature, atmospheric pressure, exhaust gas quality, etc.. After the electronic computer 50 has performed the calculation described above, the flow of control passes to enter next the DETERMINE TEMPERATURE ETC. CORRECTION COEFFICIENT TCC block.

In the DETERMINE TEMPERATURE ETC. CORRECTION COEFFICIENT TCC block, a value TCC is derived as a correction coefficient to adjust the basic amount of fuel BF to be supplied to the combustion chambers 5 of the internal combustion engine 1 according to the current value of the temperature of the intake air which is being sucked in through the air cleaner 15 into the combustion chambers 5, as measured by the intake air temperature sensor 24, and according to the current value of the external atmospheric pressure as measured by the atmospheric pressure sensor 25, and possibly according to other engine operational parameters. Various methods are already well known in the art for performing this derivation of such a correction factor as TCC, and therefore this calculation will not particularly be further described here. For example, table look up may be used. The factor TCC is represented as a multiplicatory corrector factor, i.e. as the ratio of the desired supplied fuel amount to the present value of this supplied fuel amount, and thus in general is either a little greater than or a little less than unity. After the electronic computer 50 has performed the determination of TCC described above, the flow of control passes to enter next the DETERMINE EXCESS AIR CORRECTION COEFFICIENT EXC block.

In the DETERMINE EXCESS AIR CORRECTION COEFFICIENT EXC block, a value EXC is derived as an exhaust gas air/fuel ratio correction factor to adjust the basic amount BF of fuel to be supplied to the combustion chambers 5 of the internal combustion engine 1 according to the current value of the excess air signal dispatched from the oxygen sensor 27 representing the air/fuel ratio of the exhaust gases in the exhaust manifold 17. This value EXC is so adjusted from time to time as to cause the air/fuel ratio in the exhaust manifold 17, over a period of time, to home in on the stoichiometric value by a feedback process, as already outlined. Various methods are, again, already well known in the art for performing this deviation of such an air/fuel ratio correction factor or excess air correction coefficient as EXC, and for managing this homing in process, and therefore this calculation will not particularly be further described here. For example, again table look up may be used. The factor EXC is again represented as a multiplicatory correction factor, i.e as the ratio of the desired supplied fuel amount to the present value of this supplied fuel amount, and thus in general is again either a little greater than or a little less than unity. After the electronic computer 50 has performed the derivation of EXC, the flow of control passes to enter next the DETERMINE WALL ADHERE COEFFICIENT AWC AND SUCKING OFF COEFFICIENT SOC block.

In the DETERMINE WALL ADHERE COEFFICIENT AWC AND SUCKING OFF COEFFICIENT SOC block, a value is determined for the adhere to the wall coefficient AWC, i.e. for the coefficient for calculating the proportion of the fuel injected through the fuel injection valve 20 in the next fuel injection pulse which will adhere to the wall surfaces of the intake manifold 11 and the intake ports 6, joining the fuel layer which is already adhered thereto; and a value is also determined for the sucking off coefficient SOC, i.e. for the coefficient for calculating the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. As explained in the portion of this specification entitled SUMMARY OF THE INVENTION, the present inventors have determined by experimental researches that it is proper to represent these concepts as simple multiplicatory coefficients, to a first approximation. This derivation of the wall adhere coefficient AWC and sucking off coefficient SOC relates to the nub of the present invention. In fact, this derivation may be performed in a subroutine of this main routine, although it is not particularly so shown in the flow charts of FIG. 3. The value of the wall adhere coefficient AWC may be of approximately the order of a few tens of percent or so, but the value of the sucking off coefficient SOC may be of the order of a few percent, i.e. is typically much smaller than the value of the wall adhere coefficient AWC, about a tenth or so thereof. Thus, very approximately, in a steady state situation in which per each fuel injection pulse the amount of fuel which is added to the layer of fuel adhering to the wall surfaces of the intake manifold 11 and of the intake port 6 is approximately equal to the amount of fuel sucked off from said layer, the total amount of fuel in said layer is typically of the order of ten times the amount of fuel injected in a single fuel injection pulse. Further, however, in a situation in which the total amount of fuel in said layer is substantially less than ten times the amount of fuel injected in a single fuel injection pulse, per each fuel injection pulse the amount of fuel which is added to the layer of fuel adhering to the wall surfaces of the intake manifold 11 and of the intake ports 6 is greater than the amount of fuel sucked off from said layer, and so the amount of fuel in this layer of fuel increases. Yet further, however, in a situation in which the total amount of fuel in said layer is substantially greater than ten times the amount of fuel injected in a single fuel injection pulse, per each fuel injection pulse the amount of fuel which is added to the layer of fuel adhering to the wall surfaces of the intake manifold 11 and of the intake ports 6 is less than the amount of fuel sucked off from said layer, and so the amount of fuel in this layer of fuel decreases.

The derivation of the adhere to the wall coefficient AWC, and the sucking off coefficient SOC, according to this preferred embodiment of the engine control method according to the present invention which is being practiced by the preferred embodiment of the engine control device according to the present invention, is performed as follows, based upon the results of the aforementioned experiments which have been performed by the present invention.

Figure 5:
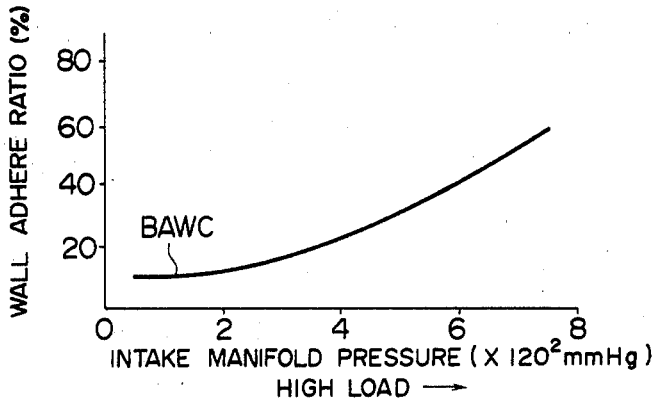
FIG. 5 is a graph, in which basic values BAWC of an adhere to the wall surfaces of the intake manifold and the intake ports coefficient AWC are shown on the ordinate and values of intake manifold pressure are shown on the abscissa, said graph being used for determining the basic value BAWC of said adhere to the wall surfaces coefficient AWC, showing that said adhere to the wall surfaces coefficient AWC is of the order of several tens of percent, and increases along with increasing intake manifold pressure.
Figure 6:
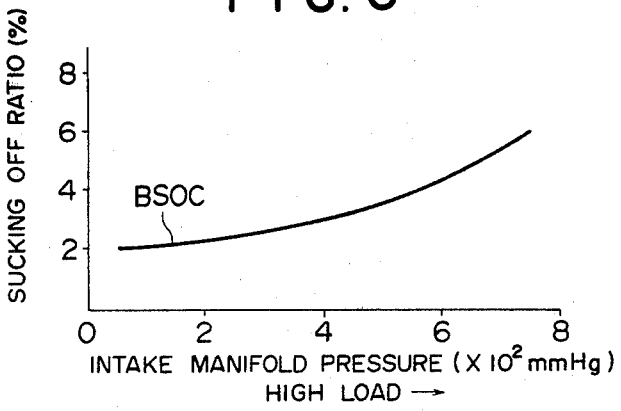
FIG. 6 is a graph, in which basic values BSOC of a sucking off coefficient SOC are shown on the ordinate and values of intake manifold pressure are shown on the abscissa, said graph being used for determining the basic value BSOC of said sucking off coefficient SOC, showing that said sucking off coefficient SOC is of the order of several percent, and increases along with increasing intake manifold pressure.

First, the basic value BAWC of the adhere to the wall coefficient AWC is determined from a table, a graph of whose values is shown in FIG. 5, in which values of intake manifold pressure (corresponding to increasing engine load) are shown on the abscissa and basic values BAWC of the adhere to the wall coefficient AWC are shown on the ordinate, and similarly the basic value BSOC of the sucking off coefficient SOC is also determined from a table, a graph of whose values is shown in FIG. 6, in which again values of intake manifold pressure (corresponding to increasing engine load) are shown on the abscissa and basic values BSOC of the sucking off coefficient AWC are shown on the ordinate. It will be seen from the graphs of FIG. 5 and FIG. 6 that the value of the adhere to the wall coefficient AWC is of the order of a few tens of percent, and increases as the intake manifold pressure increases, and that the value of the sucking off coefficient SOC is of the order of a few percent, and similarly increases as the intake manifold pressure increases.

Figure 7:
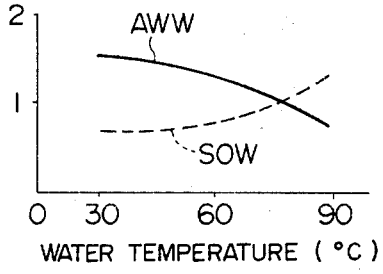
FIG. 7 is a graph, in which values of a correction factor AWW for the adhere to the wall coefficient AWC according to the temperature of the cooling water of the internal combustion engine and values of a correction factor SOW for the sucking off coefficient SOC also according to the temperature of the cooling water of the internal combustion engine are shown on the ordinate and values of engine cooling water temperature are shown on the abscissa, showing that said correction factor AWW decreases with increasing engine temperature, while said correction factor SOW increases with increasing engine cooling water temperature.

Next, a correction factor AWW for the basic value BAWC of the adhere to the wall coefficient AWC is determined according to the temperature of the cooling water of the internal combustion engine 1 from a table, a graph of whose values is shown in FIG. 7, in which figure values of engine cooling water temperature are shown on the abscissa and values of said correction factor AWW are shown on the ordinate, and similarly the value of a correction factor SOW for the basic value BSOC of the sucking off coefficient SOC according to the temperature of the cooling water of the internal combustion engine 1 is also determined from another table, a graph of whose values is also shown in FIG. 7, values of said correction factor SOW also being shown on the ordinate in this figure. It will be seen from the graphs of FIG. 7 that the value of the correction factor AWW for the basic adhere to the wall coefficient BAWC in terms of engine cooling water temperature is of the order of unity, and decreases as the engine cooling water temperature increases, and that the value of the correction factor SOW for the basic sucking off coefficient BSOC is also of the order of unity, but contrarily increases as the engine cooling water temperature increases.

Figure 8:
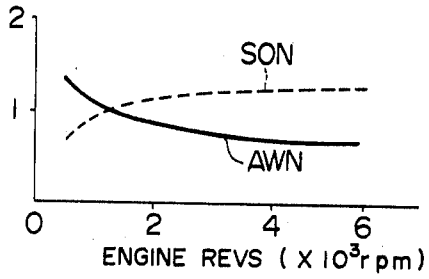
FIG. 8 is a graph, in which values of a correction factor AWN for the adhere to the wall coefficient AWC according to the revolution speed of the internal combustion engine and values of a correction factor SON for the sucking off coefficient SOC also according to the revolution speed of the internal combustion engine are shown on the ordinate and values of engine revolution speed are shown on the abscissa, showing that said correction factor AWN decreases with increasing engine revolution speed, while said correction factor SON increases with increasing engine revolution speed.

Next, a correction factor AWN for the basic value BAWC of the adhere to the wall coefficient AWC is determined according to the revolution speed N of the internal combustion engine 1 from a table, a graph of whose values is shown in FIG. 8, in which figure values of engine revolution speed N are shown on the abscissa and value of said correction factor AWN are shown on the ordinate, and similarly the value of a correction factor SON for the basic value BSOC of the sucking off coefficient SOC according to the revolution speed N of the internal combustion engine 1 is also determined from another table, a graph of whose values is also shown in FIG. 8, values of said correction factor SON also being shown on the ordinate in this figure. It will be seen from the graphs of FIG. 8 that the value of the correction factor AWN for the basic adhere to the wall coefficient BAWC in terms of engine revolution speed N is of the order of unity, and decreases as the engine revolution speed N increases, and that the value of the correction factor SON for the basic sucking off coefficient BSOC is also of the order of unity, but contrarily increases as the engine revolution speed N increases.

Figure 9:
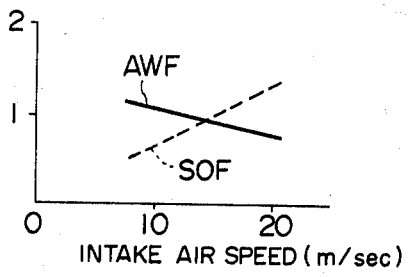
FIG. 9 is a graph, in which values of a correction factor AWF for the adhere to the wall coefficient AWC according to the intake air flow speed of the internal combustion engine and values of a correction factor SOF for the sucking off coefficient SOC also according to the intake air flow speed of the internal combustion engine are shown on the ordinate and values of engine intake air flow speed are shown on the abscissa, showing that said correction factor AWF decreases with increasing engine intake air flow speed, while said correction factor SOF increases with increasing engine intake air flow speed.

Next, a correction factor AWF for the basic value BAWC of the adhere to the wall coefficient AWC is determined according to the intake air flow speed of the internal combustion engine 1 from a table, a graph of whose values is shown in FIG. 9, in which figure values of engine intake air flow speed are shown on the abscissa and values of said correction factor AWF are shown on the ordinate, and similarly the basic value of a correction factor SOF for the basic value BSOC of the sucking off coefficient SOC according to the intake air flow speed of the internal combustion engine 1 is also determined from another table, a graph of whose values is also shown in FIG. 9, values of said correction factor SOF also being shown on the ordinate in this figure. It will be seen from the graphs of FIG. 9 that the value of the correction factor AWF for the basic adhere to the wall coefficient BAWC in terms of engine intake air flow speed is of the order of unity, and decreases as the engine intake air flow speed increases, and that the value of the correction factor SOF for the basic sucking off coefficient BSOC is also of the order of unity, but contrarily increases as the engine intake air flow speed increases.

After the basic values BAWC and BSOC for the adhere to the wall coefficient AWC and for the sucking off coefficient SOC and these various correction factors therefor have been found, the final or adjusted values of said adhere to the wall coefficient AWC and for the sucking off coefficient SOC are derived therefrom by multiplying the basic value BAWC for the adhere to the wall coefficient AWC by the values of all three of its correction factors, and by multiplying the basic value BSOC for the sucking off coefficient SOC by the values of all three of its correction factors; in other words, according to the following equations:

$$AWC=BAWC*AWW*AWN*AWF$$

and $$SOC=BSOC*SOW*SON*SOF$$

After the electronic computer 50 has performed, in this DETERMINE WALL ADHERE COEFFICIENT AWC AND SUCKING OFF COEFFICIENT SOC block, the determination of the wall adhere coefficient AWC and the sucking off coefficient SOC described above, the flow of control passes to enter next the CALCULATED DESIRED COMBUSTION CHAMBER FUEL DFC=BF*TCC*EXC block, in which the amount DFC of fuel which is proper to be introduced into the combustion chambers 5 of the internal combustion engine 1 is calculated according to the value of BF and according to the two adjustment or correction factors TCC and EXC that have been calculated, by multiplying the basic amount of fuel BF that is desired to be supplied into said combustion chambers by the temperature correction factor TCC that has already been determined and by the air/fuel ratio correction factor or excess air correction coefficient EXC. Thus, when it is time for fuel injection, as will be seen later the interrupt routine whose flow chart is shown in FIG. 4 causes such an amount SQF of fuel to be squirted in through the fuel injection valve 20 as to cause this amount DFC of fuel to be supplied to the combustion chambers 5 of the internal combustion engine 1.

After this CALCULATE DESIRED COMBUSTION CHAMBER FUEL DFC=BF*TCC*EXC block, the flow of control of this main routine whose flow chart is shown in FIG. 3 for the electronic control computer 50 returns to enter next the DATA INPUT block, at substantially the beginning of this main routine again, and repeats the cycle described.

It should be particularly noted that actual outputting of a digital value which causes the desired amount SQF (to be explained later) of fuel to be injected through the fuel injection valve 20, i.e. actual initiation of a pulse of fuel injection through the fuel injection valve 20, never occurs during the time that the electronic computer 50 is executing any part of the cycle of this main routine whose flow chart is shown in FIG. 3; the timing of this main routine is not particularly fixed, although typically it may take about three milliseconds to execute, as stated above. The actual command for starting of a pulse of injection of fuel through the fuel injection valve 20 is given by the electronic computer 50 while executing the interrupt routine whose flow chart is shown in FIG. 4, which will be explained later, and which is performed for every 120°, for example, of crank angle, according to an interrupt signal dispatched from the revolution sensor 28 fitted to the distributor 18 as input via the amplifier 65, as mentioned earlier.

EXPLANATION OF THE INTERRUPT ROUTINE FLOW CHART OF FIG. 4

FIG. 4 is another partial flow chart, showing the overall flow of an interrupt routine which is executed repeatedly, once every time the crankshaft of the engine rotates through an angle of 120°, for example, during the operation of said electronic computer which is incorporated in the preferred embodiment of the engine control device according to the present invention shown in FIGS. 1 and 2 while said engine control device is practicing the preferred embodiment of the engine control method according to the present invention. The performance of the computer program which is currently being executed by the electronic computer 50, which may well be the main routine whose flow chart is given is FIG. 3, is interrupted every time a crank angle signal is received by the input port 54 from the crank angle sensor 28 fitted to the distributor 18 via the amplifier 65, and the computer program of FIG. 4 is then immediately preferentially executed instead.

The electronic computer 50, during the execution of this interrupt routine, performs in sequence several distinct functions. First, it decides whether or not it is currently a time for injecting a pulse of fuel of suitable duration and amount through the fuel injection valve 20 to provide an amount of fuel determined by the current value of DFC into the combustion chambers 5 of the internal combustion engine 1 during the next engine cycle, and if this is not the case then the flow of control skips directly to the last stage of this interrupt routine, i.e. to the stage which calculates the up to date value of engine revolution speed N as explained later. On the other hand, if it is now fuel injection time, then the electronic computer 50 in any case will definitely be required to update the value WF which represents the amount of fuel present in the film of liquid fuel adhered to the wall surfaces of the intake manifold and the intake valves, and accordingly the sucked off amount SOA of this fuel which has been sucked off from these wall surfaces since the last fuel injection pulse is calculated. Then, the electronic computer 50 makes a decision as to whether it is currently time to cut off the injection of fuel through the fuel injection valve 20, i.e. as to whether it is currently a time of deceleration with the throttle of the internal combustion engine 1 fully closed. If it is such a fuel cut off time, then the electronic computer 50 updates the value of the amount WF of fuel present in the film of liquid fuel adhered to the wall surfaces by subtracting from it the just recently calculated value of the sucked off amount SOA of this fuel, and proceeds to the last stage of this interrupt routine. On the other hand, if it is not such a fuel cut off time, then the electronic computer 50 calculates the proper value of the amount SQF of the fuel that should be injected in a squirt through the fuel injection valve 20 in this upcoming fuel injection pulse, in order for the desired amount DFC of fuel to be supplied to the combustion chambers 5 of the internal combustion engine 1 in the next engine cycle, bearing in mind the amount of this upcoming pulse of squirted in fuel that will adhere to the wall surfaces of the intake manifold 11 and the intake ports 6, and bearing in mind the amount of fuel that was adhered to these wall surfaces that is sucked off said wall surfaces by the air flow passing these surfaces, already calculated. Then, the electronic computer 50 adds to the time of opening of the fuel injection valve 20 representing this amount SQF of fuel to be injected a time DT representing the so called dead time of the fuel injection valve, i.e. its operational lag, to produce a value AFC, and next the electronic computer 50 outputs a command to commence said fuel injection pulse of duration determined by the current value of AFC. Finally, the electronic computer 50 calculates the current value N of engine revolution speed.

The flow of control of the electronic control computer 50, in this interrupt routine of FIG. 4, starts by transiting into the FUEL INJECTION TIME ? decision block.

In the FUEL INJECTION TIME ? decision block, a decision is made as to whether the present crank angle interrupt, which has occurred because the event has occurred that the crankshaft of the internal combustion engine 1 has turned through 120°, for example, of crank angle from the last such interrupt, i.e. that the crankshaft of the internal combustion engine 1 has reached the next one of three points in the crank angle diagram which are spaced apart from one another, in this example, by angles of 120° around said crank angle diagram (such as, for example, the points 120°, 240°, and 360°, or the like, according to the particular construction of the distributor 18 and of the crank angle sensor 28), is an interrupt at which a pulse of fuel (of duration and amount corresponding to the current value of AFC, as will be seen later) should be injected into the intake manifold 11 of the internal combustion engine 1 through the fuel injection valve 20, or not. The meaning of this test is that, depending upon the particular construction of the fuel injection system of the internal combustion engine 1, fuel injection may be designed to occur once per crankshaft revolution, or possibly once per two crankshaft revolutions, or at some other occurrence frequency. In any case, the time between the starting instants of successive pulses of fuel injection should be an integral multiple of the time between successive computer interrupts caused by the crankshaft rotating through 120°, as exemplarily taken i.e., in this example, successive pulses of fuel injection should start at points in the crank angle diagram spaced apart by angles which are some multiple of 120°. Thus, this FUEL INJECTION TIME ? decision blocks serves to decide whether this particular interrupt is in fact a fuel injection interrupt. This decision can be based upon, for example, counting upwards in a counter which is reset at the start of every fuel injection pulse, or the like; the details will easily be completed by one of ordinary skill in the computer art, based upon the disclosure herein. If the result of the decision in this FUEL INJECTION TIME ? decision block is YES, i.e. if this particular interrupt is in fact a fuel injection interrupt, then the flow of control passes to enter next the SOA=-SOC*WF block, and otherwise if the result of the decision in this FUEL INJECTION TIME ? decision block is NO, i.e. if this particular interrupt is in fact not a fuel injection interrupt, then the flow of control passes to enter next the CALCULATE N block.

Thus, in this NO branch from this FUEL INJECTION TIME ? decision block, since it is decided at this point that this particular interrupt is in fact not a fuel injection interrupt, then the flow of control skips to the end of this interrupt routine, or rather to the last function to be executed thereby in said CALCULATE N block.

On the other hand, in the YES branch from this FUEL INJECTION TIME ? decision block, it is decided at this point that this particular interrupt is in fact a fuel injection interrupt, and therefore at this point actual fuel injection should be initiated, providing as seen later that it is not time to cut off the injection of fuel. Thus, the flow of control passes to enter next the SOA=SOC*WF block.

In this SOA=SOA*WF block, since it is now decided that the present interrupt instant is a fuel injection type interrupt instant, which is as explained above a determined angle away in the crank angle diagram from the last fuel injection type interrupt instant, whether fuel cut off is required to be performed or not, a certain amount of fuel will have been sucked off from the film of liquid fuel which is adhering to the side wall surfaces of the intake manifold 11 and the intake ports 6 since said last fuel injection type interrupt instant, and accordingly the value of the variable WF which represents the amount of fuel in said film of liquid fuel adhering to said wall surfaces must be updated. Therefore, in this SOA=SOC*WF block, the value is calculated of SOA the sucking off amount, i.e. of the actual amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. This calculation is made by multiplying the total amount WF of fuel in said film of liquid fuel by SOC the sucking off coefficient, i.e. the proportion or ratio of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. This sucking off coefficient SOC was calculated, as explained above, in the main routine of the electronic control computer 50 whose flow chart is shown in FIG. 3. From this SOA=SOC*WF block, the flow of control passes to enter next the FUEL CUT OFF TIME ? decision block.

In the FUEL CUT OFF TIME ? decision block, a decision is made as to whether it is currently time to cut off the injection of fuel through the fuel injection valve 20, i.e. as to whether it is currently a time of deceleration with the throttle of the internal combustion engine 1 fully closed. Thus, this FUEL CUT OFF TIME ? decision block serves to decide whether actually fuel should be injected at this particular time or not. If the result of the decision in this FUEL CUT OFF TIME ? decision block is NO, i.e. if fuel cut off is not to be performed at this time, then the flow of control passes to enter next the SQF=(DFC−SOA)/(1−AWC) block, and otherwise if the result of the decision in this FUEL CUT OFF TIME ? decision block is YES, i.e. if at this time fuel cut off is to be performed so that actually no fuel is to be injected at this time, then the flow of control passes to enter next the WF=WF−SOA block.

In the NO branch from this FUEL CUT OFF TIME ? decision block, since it is decided at this point that fuel cut off is not to be performed at this time, it is next necessary to calculate the actual amount of fuel to be injected through the fuel injection valve 20. Therefore, the flow of control passes to enter next the SQF=(DFC−SOA)/(1−AWC) block.

In this SQF=(DFC−SOA)/(1−AWC) block, the value of SQF, the actual amount of fuel to be squirted in through the fuel injection valve 20 for this fuel injection pulse, is set to the value (DFC−SOA)/(1−AWC), by calculation from the values of: DFC the desired amount of fuel to be supplied into the combustion chambers 5 of the internal combustion engine 1 by the next pulse of fuel injection through the fuel injection valve 20, which has been calculated in the last execution of the main routine of the electronic control computer 50 whose flow chart is shown in FIG. 3; of SOA the amount of the fuel adhering to the wall surfaces of the intake manifold 11 and the intake ports 6 after the last fuel injection pulse which will have been sucked off therefrom during the time period between said last fuel injection pulse and the current fuel injection pulse os as to be swept into the combustion chambers 5, which has just been calculated; and of AWC the adhere to the wall coefficient, i.e. the proportion of the fuel injected through the fuel injection valve 20 in the next fuel injection pulse which will adhere to the wall surfaces of the intake manifold 11 and the intake ports 6, which has been calculated in the last execution of the main routine of the electronic control computer 50 whose flow chart is shown in FIG. 3; all these values being already known values. The reason for the use of this particular formula for calculating SQF will be explained shortly; the formula has been determined according to the fact that, as explained later, the actual amount AWA of the fuel injected through the fuel injection valve 20 in the present fuel injection pulse which will adhere to the wall surfaces of the intake manifold 11 and the intake ports 6 depends upon the amount SQF of squirted in fuel. From this SQF=(DFC−SOA)/(1−AWC) block, the flow of control passes to enter next the AWA=SQF*AWC block.

In this AWA=SQF*AWC block, the value is calculated of AWA the amount of the fuel injected through the fuel injection valve 20 in the present fuel injection pulse which will adhere to the wall surfaces of the intake manifold 11 and the intake ports 6, i.e. the amount of the fuel in the present fuel injection pulse of magnitude SQF which will not reach the combustion chambers 5, but which will be absorbed into the layer or film of fuel on said wall surfaces. This calculation is made by multiplying the total amount SQF of fuel to be squirted in through the fuel injection valve 20 for this fuel injection pulse by AWC the adhere to the wall coefficient, i.e. the proportion of the fuel injected through the fuel injection valve 20 in the next fuel injection pulse which will adhere to the wall surfaces of the intake manifold 11 and the intake ports 6. This adhere to the wall coefficient AWC was calculated, as explained above, in the last execution of the main routine of the electronic control computer 50 whose flow chart is shown in FIG. 3. From this AWA=SQF*AWC block, the flow of control passes to enter next the WF=WF+AWA−SOA block.

In this WF=WF+AWA−SOA block, the process is performed of updating the value of WF, the amount of fuel present in the film of fuel adhering to the wall surfaces of the intake manifold 11 and the intake ports 6, by adding thereto the amount AWA of fuel which will adhere thereto on this fuel injection pulse, and by then subtracting therefrom the value of SOA, the sucked off amount of fuel. Thus a cumulative calculation is made of this value WF of the amount of fuel present in the film of fuel adhering to the wall surfaces of the intake manifold 11 and the intake ports 6. From this WF=WF+AWA−SOA block, the flow of control passes to enter next the AFC=SQF+DT block.

At this point it is proper to verify that the above formula for determining SQF, which set the value of SQF to (DFC−SOA)/(1−AWC), in fact gives the correct amount of fuel supply to the combustion chambers 5 of the internal combustion engine 1. In fact, the amount of fuel which reaches the combustion chambers 5 is clearly equal to SQF−AWA+SOA, i.e. is equal to the amount of injected fuel, minus the amount of this injected fuel which will not reach the combustion chambers 5 because it is added to the adhered layer of liquid fuel on the wall surfaces of the intake manifold 11 and the intake ports 6, plus the amount of fuel which will have been sucked off these wall surfaces.

Thus, this amount of fuel which reaches the combustion chambers 5, substituting for AWA, is equal to:

$$SQF-SQF*AWC+SOA;$$

which rearranged equals:

$$SQF*(1-AWC)+SOA;$$

which, substituting for SQF, equals:

((DFC−SOA)*(1−AWC))/(1−AWC)+SOA;

which cancels out to DFC, which is in fact exactly the desired amount of fuel to be supplied into the combustion chambers 5 of the internal combustion engine 1 by the next pulse of fuel injection through the fuel injection valve 20, as calculated by the last execution of the main routine of the electronic control computer 50 whose flow chart is shown in FIG. 3. This verifies the previously given formula.

Next, in the AFC=SQF+DT block, a value DT is added to this value SQF representing the proper amount of fuel to be injected through the fuel injection valve 20 in the next fuel injection pulse, to give the amount of time that is proper to command the fuel injection valve 20 to be opened. It should be remembered, as stated above, that in these discussions times of opening of the fuel injection valve 20 and amounts of fuel to be injected therethrough have been spoken of without particular distinction being made between them. This value DT corresponds to the dead time of the fuel injection valve 20, i.e. to its time lag after it is opened and before it commences to inject fuel into the intake manifold 11, less its time lag after it is closed and before it ceases to inject fuel into the intake manifold 11. From this AFC=SQF+DT block, the flow of control passes to enter next the OUTPUT FUEL INJECTION PULSE (LENGTH AFC) START COMMAND block.

In this OUTPUT FUEL INJECTION PULSE (LENGTH AFC) START COMMAND block, the value of the proper or actual amount AFC of the time that the fuel injection valve 20 is to be actually commanded to be opened is output by the CPU 51, via the output port 55, to the flipflop 75, which is SET by this signal representative of the amount AFC of time that the fuel injection valve 20 is to be actually commanded to be opened, so as to cause its output to be energized, said output of said flipflop 75 being amplified by the amplifier 76 and being supplied to the fuel injection valve 20 so as to open it. The value of the proper amount AFC of time for opening of the fuel injection valve 20 is also supplied at the same time to the down counter 74 which is thereby set to said value AFC. As mentioned before, the down counter 74 counts down from this value AFC according to a clock signal supplied from the clock pulse generator or clock 57, and, when the value in the down counter 74 reaches zero, then the down counter 74 RESETs the flipflop 75, so as to cause its output to cease to be energized, and so as thereby to close the fuel injection valve 20 so as to terminate the supply of liquid fuel into the intake manifold 11 of the internal combustion engine 1. By such an arrangement, the duration of the pulse of injected liquid fuel is made to be proportional to the signal value AFC outputted by the CPU 51 to the flipflop 75 and the down counter 74; however, other possible arrangements could be envisaged, and the details thereof are not directly relevant to the present invention. In any case, functionally, the I/O device comprising, in this embodiment, the flipflop 75, the down counter 74, and the amplifier 76, when it receives an output signal of value equal to AFC the desired fuel injection pulse time from the electronic computer 50, substantially immediately opens the fuel injection valve 20 by proper supply of actuating electrical energy thereto, and keeps said fuel injection valve 20 open until an amount of time corresponding to the value of AFC has elapsed, so that a corresponding amount of fuel (allowing for the aforesaid dead fuel injection time DT) has been supplied through said fuel injection valve 20 into the intake manifold 11 of the internal combustion engine 1 so as to be combusted in the combustion chambers 5 thereof. From this OUTPUT FUEL INJECTION PULSE (LENGTH AFC) START COMMAND block, the flow of control passes to enter next the CALCULATE N block, the function of which will be explained later.

On the other hand, in the YES branch from the FUEL CUT OFF TIME ? decision block, since it is decided at this point that fuel cut off is to be performed at this time, and therefore at this point no fuel is to be injected into the intake manifold 11 through the fuel injection valve 20, and it is only necessary to update the value of WF, the amount of fuel present in the film of fuel adhering to the wall surfaces of the intake manifold 11 and the intake ports 6, by subtracting therefrom the value of SOA, the sucked off amount of fuel. Therefore, the flow of control passes to enter next the WF=WF−SOA block.

In this WF=WF−SOA block, thus, the value of WF, the amount of fuel present in the film of fuel adhering to the wall surfaces of the intake manifold 11 and the intake ports 6, is updated by subtracting therefrom the value of SOA the sucked off amount of fuel. Of course in this case, since no fuel has been injected through the fuel injection valve 20, no account need be taken of any newly adhered fuel amount. From this WF=WF−SOA block, the flow of control passes to enter next the CALCULATE N block.

When control has arrived at this CALCULATE N block, the matters of initiating fuel injection, if such fuel injection in fact is proper at this time, and of updating the value of WF, the amount of fuel adhering to the wall surfaces of the intake manifold 11 and the intake ports 6, have been attended to by this interrupt routine, and finally the matter of calculating the new current value of engine revolution speed N, as will now be explained, is attended to. Thus, in this block, the electronic computer 50 calculates the current or newest value of N, by consulting a real time clock to find how much real time has elapsed during the last 120°, for example, of rotation of the crankshaft of the internal combustion engine, for example; although other ways could be considered. Again, the details of this calculation are per se well known in various forms to those skilled in the art, and are not directly relevant to the present invention. After this CALCULATE N block, the flow of control passes to the END of this interrupt routine, so as to return to the current control point of the program which was interrupted by the interrupt which caused the calling of this interrupt routine, which may well be the main routine whose flow chart is given in FIG. 3, or could conceivably be some other routine, such as another interrupt routine, which was being executed by the control of the electronic computer 50, just before this execution was interrupted by the interrupt which caused the starting of this interrupt routine of FIG. 4.

Now, with reference to FIGS. 10*a*, 10*b*, 10*c*, and 11, the performance of the engine control device described above, which is the preferred embodiment of the engine control device according to the present invention and practices the preferred embodiment of the engine control method according to the present invention, will be illustrated, and will be contrasted with the performance of a prior art type fuel injected engine control device.

Figure 10A:
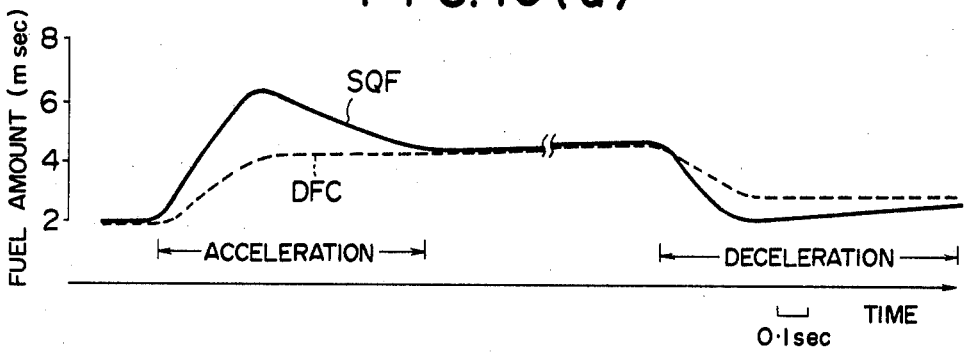
FIG. 10*a* is a time chart, in which amount of fuel is shown on the ordinate and time is shown on the abscissa, showing respectively by the dashed line and by the solid line the variation with respect to time of the desired amount of fuel to be supplied into the combustion chambers of the internal combustion engine by the next pulse of fuel injection through the fuel injection valve, and of the actual amount of fuel to be squirted in through the fuel injection valve into the intake manifold during this fuel injection pulse, with respect to time, during an engine operational episode in which first the engine is being operated in a steady operational mode at a relatively low engine load level, then subsequently the engine is accelerated, then subsequently the engine is operated in a steady operational mode at a higher load level, then subsequently the engine is decelerated, and finally the engine is operated in a steady operational mode at a relatively lower load level again; this figure showing that during steady operation of the engine the value of the desired amount of fuel to be supplied is substantially equal to the value of the actual amount of fuel to be squirted in through the fuel injection valve, but that during acceleration of the engine the value of the actual amount of fuel to be squirted in through the fuel injection valve must be made substantially greater than the value of the desired amount of fuel to be supplied in order to allow for increase of the amount of fuel adhering to the wall surfaces of the intake manifold and of the intake ports, while on the other hand during deceleration of the engine the value of the actual amount of fuel to be squirted in through the fuel injection valve must be made substantially less than the value of the desired amount of fuel to be supplied in order to allow for decrease of the amount of fuel adhering to these wall surfaces.
Figure 10B:
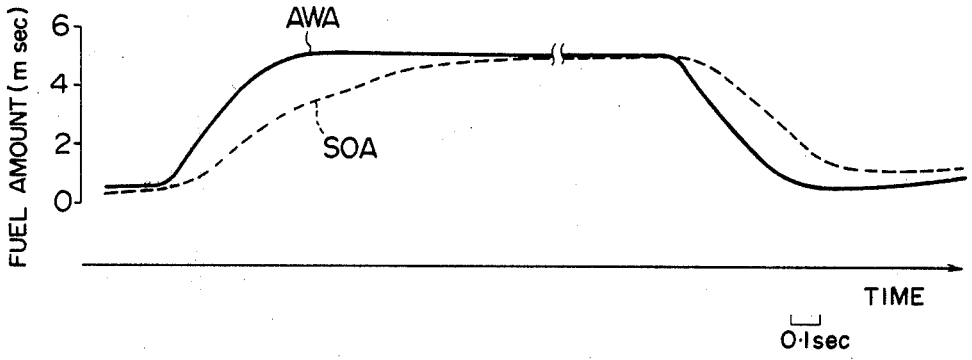
FIG. 10*b* is a time chart, in which amount of fuel is shown on the ordinate and time is shown on the abscissa, said abscissa corresponding to and indicating the same times as the abscissa of FIG. 10*a*, showing respectively by the solid line and by the dashed line the variation with respect to time, during the same engine operational episode as the episode illustrated in FIG. 10*a*, of the actual amount of the fuel injected through the fuel injection valve in the next fuel injection pulse which will adhere to the wall surfaces of the intake manifold and the intake ports, and of the actual amount of the fuel adhering to the wall surfaces of the intake manifold and the intake ports after the last fuel injection pulse which will have been sucked off therefrom during the time period between said last fuel injection pulse and the current fuel injection pulse so as to be swept into the combustion chambers, and showing that during steady operation of the engine the value of the adhered fuel amount is substantially equal to the value of the sucked off fuel amount, but that during acceleration of the engine the value of the adhered fuel amount becomes substantially greater than the value of the sucked off fuel amount, while on the other hand during deceleration of the engine the value of the adhered fuel amount becomes substantially less than the value of the sucked off fuel amount.
Figure 10C:
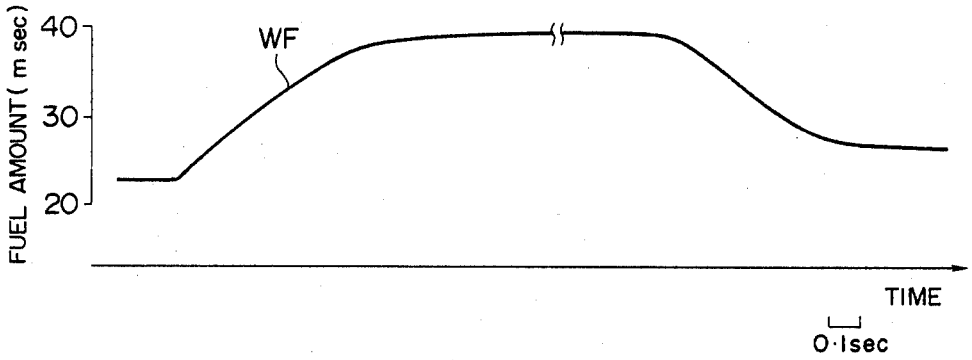
FIG. 10*c* is a time chart, in which amount of fuel is shown on the ordinate and time is shown on the abscissa, said abscissa corresponding to and indicating the same times as the abscissas of FIG. 10*a* and FIG. 10*b*, showing the variation, during the same engine operational episode as the episode illustrated in those previous figures, of the total or cumulative amount of fuel which is currently adhering to the wall surfaces of the intake manifold and the intake ports, and showing that during steady operation of the internal combustion engine the value of the cumulative adhering fuel amount remains substantially constant, but that during acceleration of the engine the value of the cumulative adhering fuel amount increases sharply and steadily, while on the other hand during deceleration of the engine the value of the cumulative adhering fuel amount decreases sharply and steadily.

FIGS. 10*a*, 10*b*, and 10*c* are all time charts, in all of which amount of fuel is shown on the ordinate; and the abscissas of these charts all illustrate the time dimension and correspond to one another. In the engine operational episode illustrated by all these time charts, first the internal combustion engine 1 is being operated in a steady operational mode at a relatively low engine load level; then subsequently the internal combustion engine 1 is accelerated; then subsequently the internal combustion engine 1 is operated in a steady operational mode at of course a relatively higher load level; then subsequently the internal combustion engine 1 is decelerated; and finally the internal combustion engine 1 is operated in a steady operational mode at of course a relatively lower load level again.

FIG. 10*a* shows respectively by the dashed line and by the solid line the behavior, during this engine operational episode, of DFC the desired amount of fuel to be supplied into the combustion chambers 5 of the internal combustion engine 1 by the next pulse of fuel injection through the fuel injection valve 20, and of SQF the actual amount of fuel to be squirted in through the fuel injection valve 20 for this fuel injection pulse. From this figure it is seen that during steady operation of the internal combustion engine 1 the value of DFC is substantially equal to the value of SQF; but that during acceleration of the internal combustion engine 1 the value of SQF must be made substantially greater than the value of DFC, in order to allow for increase of the amount of fuel adhering to the wall surfaces of the intake manifold 11 and the intake ports 6 caused by excess of the adhere fuel amount AWA over the suck off fuel amount SOA; while on the other hand during deceleration of the internal combustion engine 1 the value of SQF must be made substantially less than the value of DFC, in order to allow for decrease of the amount of fuel adhering to the wall surfaces of the intake manifold 11 and the intake ports 6 caused by excess of the suck off fuel amount SOA over the adhere fuel amount AWA.

FIG. 10*b* shows respectively by the solid line and by the dashed line the behavior, during this engine operational episode, of AWA the adhere to the wall amount of fuel, i.e. the actual amount of the fuel injected tnrough the fuel injection valve 20 in the next fuel injection pulse which will adhere to the wall surfaces of the intake manifold 11 and the intake ports 6, and of SOA the sucking off amount of fuel, i.e. the actual amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. From this figure it is seen that during steady operation of the internal combustion engine 1 the value of AWA is substantially equal to the value of SOA; but that during acceleration of the internal combustion engine 1 the value of the amount AWA of the injected fuel which adheres to the wall surfaces of the intake manifold 11 and the intake ports 6 becomes substantially greater than the value of the amount DFC of the fuel adhering to the wall surfaces of the intake manifold 11 and the intake ports 6 after the last fuel injection pulse which is sucked off therefrom; while on the other hand during deceleration of the internal combustion engine 1 the value of the amount AWA of the injected fuel which adheres to the wall surfaces of the intake manifold 11 and the intake ports 6 becomes substantially less than the value of the amount DFC of the fuel adhering to the wall surfaces of the intake manifold 11 and the intake ports 6 after the last fuel injection pulse which is sucked off therefrom.

FIG. 10*c* shows the behavior, during this engine operational episode, of WF the total or cumulative amount of fuel which is currently adhering to the wall surfaces of the intake manifold 11 and the intake ports 6. From this figure it is seen that during steady operation of the internal combustion engine 1 the value of WF the adhering fuel amount remains substantially constant; but that during acceleration of the internal combustion engine 1 the value of the adhering fuel amount WF increases sharply and steadily; while on the other hand during deceleration of the internal combustion engine 1 the value of the adhering fuel amount WF decreases sharply and steadily.

Figure 11:
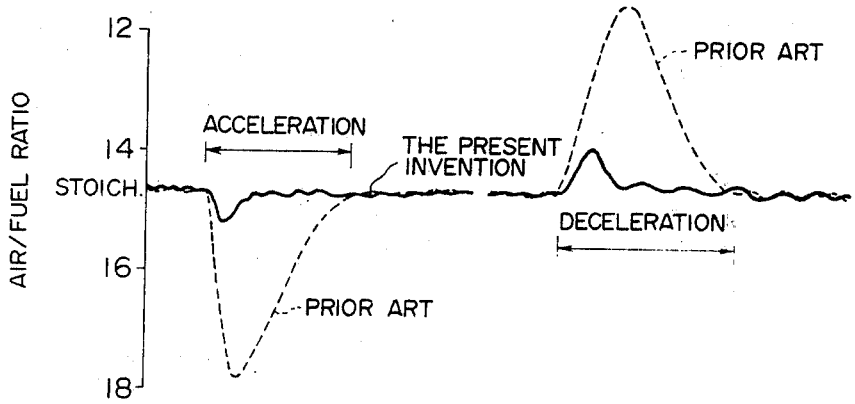
FIG. 11 is a time chart, in which air/fuel ratio of delivered air-fuel mixture is shown on the ordinate, and time is shown on the abscissa, showing by the solid line the behavior of variation of air/fuel ratio of the intake air-fuel mixture of an internal combustion engine with a fuel injection system controlled according to the preferred embodiment of the engine control method according to the present invention, as contrasted with the behavior of variation of air/fuel ratio of the air-fuel mixture of an engine with a fuel injection system controlled according to a prior art method, which is shown by the dashed line, both these variation behaviors being shown during a similar operational episode to the episode illustrated in FIGS. 10*a*, 10*b*, and 10*c*; and showing that during steady operation of the engine both the air/fuel ratio of the air-fuel mixture in the engine controlled according to the present invention and the air/fuel ratio of the air-fuel mixture in the engine controlled in a prior art fashion are substantially stoichiometric; but that during acceleration of the engine, whereas the air/fuel ratio of the air-fuel mixture in the engine controlled in a prior art fashion deviates substantially from stoichiometric towards the lean side, i.e. undergoes a lean spike, by contrast the air/fuel ratio of the air-fuel mixture in the engine controlled according to the present invention does not deviate substantially from stoichiometric, i.e. does not undergo any lean spike; while on the other hand during deceleration of the engine, whereas the air/fuel ratio of the air-fuel mixture in the engine controlled in a prior art fashion similarly deviates substantially from stoichiometric towards the rich side, i.e. undergoes a rich spike, by contrast the air/fuel ratio of the air-fuel mixture in the engine controlled according to the present invention does not deviate substantially from stoichiometric, i.e. does not undergo any rich spike.

In FIG. 11, the behavior of variation of air/fuel ratio of the air-fuel mixture delivered by the fuel injection system described above, which is shown by the solid line, is contrasted with the behavior of variation of air/fuel ratio of the air-fuel mixture delivered by a prior art type fuel injection system, which is shown by the dashed line. FIG. 11 is a time chart, in which air/fuel ratio of delivered air-fuel mixture is shown on the ordinate, and time is shown on the abscissa. In the engine operational episode illustrated by this time chart, again, first the internal combustion engine 1 is being operated in a steady operational mode at a relatively low engine load level; then subsequently the internal combustion engine 1 is accelerated; then subsequently the internal combustion engine 1 is operated in a steady operational mode at of course a relatively higher load level; then subsequently the internal combustion engine 1 is decelerated; and finally the internal combustion engine 1 is operated in a steady operational mode at of course a relatively lower load level again.

From this figure it is seen that during steady operation of the internal combustion engine 1 both the air/fuel ratio of the air-fuel mixture delivered by the fuel injection system described above and the air/fuel ratio of the air-fuel mixture delivered by a prior art type fuel injection system are substantially stoichiometric; but that during acceleration of the internal combustion engine 1, whereas the air/fuel ratio of the air-fuel mixture delivered by a prior art type fuel injection system deviates substantially from stoichiometric towards the lean side, i.e. undergoes a lean spike, by contrast the air/fuel ratio of the air-fuel mixture delivered by the fuel injection system described above does not deviate substantially from stoichiometric, i.e. does not undergo any lean spike; while on the other hand during deceleration of the internal combustion engine 1, whereas the air/fuel ratio of the air-fuel mixture delivered by a prior art type fuel injection system similarly deviates substantially from stoichiometric towards the rich side, i.e. undergoes a rich spike, by contrast the air/fuel ratio of the air-fuel mixture delivered by the fuel injection system described above does not deviate substantially from stoichiometric, i.e. does not undergo any rich spike. Thus it is seen that, according to the present invention, during acceleration and deceleration of the internal combustion engine 1, as well as during steady operation thereof, the internal combustion engine 1 is supplied with an air-fuel mixture of substantially correct or stoichiometric air/fuel ratio, which is very beneficial with regard to giving good drivability of the internal combustion engine 1, as well as with regard to providing good quality for the exhaust emissions of said internal combustion engine 1.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For instance, although in the foregoing the present invention has been explained with regard to its application to a so called D-jetronic type of fuel injection system, in which the operational parameters of the internal combustion engine which are measured in order to calculate the basic amount of fuel to be injected are intake manifold pressure and engine revolution speed, in fact the present invention is equally applicable to the so called L-jetronic type of fuel injection system, in which the operational parameters of the internal combustion engine which are measured in order to calculate the basic amount of fuel to be injected are intake air amount or flow speed and engine revolution speed. Further, although in the shown embodiment the process was performed of cutting off fuel injection in certain engine operational circumstances, this is not essential to the present invention. The most general form of the present invention does not necessitate such a fuel injection cutting off procedure; however, the shown embodiment of the present invention, which is the preferred one, does utilize such a fuel cut off, and therefore the details of the adaptation of the present invention involved in providing a computer program that also performs fuel cut off have been described. The details of a computer program that does not perform such fuel cut off may be easily filled in by one of ordinary skill in the art, based upon the disclosure herein. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. For an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle:

an engine control method, comprising the processes, repeatedly and alternatingly and/or simultaneously performed, of:

(a) sensing the current values of certain operational parameters of said internal combustion engine;

(b) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (c) at time points in said operational cycle of said internal combustion engine and said fuel injection valve which are proper fuel injection time points, performing the following processes in the specified order:

(c1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

(c2) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse;

(c3) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system;

(c4) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

(c5) modifying said actuating signal according to the value of said sixth quantity representing the actual fuel amount to be injected through said fuel injection valve in the next fuel injection pulse; and (c6) supplying said modified actuating signal to said fuel injection valve in such a fashion as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold;

wherein the method used in subprocess (c2) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

2. For an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle:

an engine control method, comprising the processes, repeatedly and alternatingly and/or simultaneously performed, of:

(a) sensing the current values of certain operational parameters of said internal combustion engine;

(b) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (c) at time points in said operational cycle of said internal combustion engine and said fuel injection valve which are proper fuel injection time points, performing the following processes in the specified order:

(c1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amont of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

and, if according to the current operational conditions of said internal combustion engine it is proper to inject fuel through said fuel injection valve, (c2) performing the following processes in the specified order:

(c2.1) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse;

(c2.2) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system;

(c2.3) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

(c2.4) modifying said actuating signal according to the value of said sixth quantity representing the actual fuel amount to be injected through said fuel injection valve in the next fuel injection pulse; and (c2.5) supplying said modified actuating signal to said fuel injection valve in such a fashion as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold;

but otherwise, if according to the current operational conditions of said internal combustion engine it is not proper to inject fuel through said fuel injection valve, (c3) performing the following process:

(c3.1) updating the value of said fourth quantity representing the total amount of fuel adhering to said walls of said air-fuel mixture intake system by subtracting therefrom the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

wherein the method used in subprocess (c2.1) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

3. An engine control method according to either one of claims 1 and 2, wherein the method used for calculating the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fourth quantity representing the total amount of fuel adhering to said walls of said air-fuel mixture intake system by the value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses.

4. An engine control method according to either one of claims 1 and 2, wherein the method used for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

5. An engine control method according to claim 3, wherein the method used for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

6. An engine control method according to either one of claims 1 and 2, wherein the method used for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

7. An engine control method according to claim 3, wherein the method used for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

8. An engine control method according to claim 4, wherein the method used for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

9. An engine control method according to claim 5, wherein the method used for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

10. For an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle:

an engine control device, comprising:

(a) a plurality of sensors, which sense the current values of certain operational parameters of said internal combustion engine;

(b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine;

(d) said electronic computer repeatedly and alternatingly and/or simultaneously:

(d1) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d2) at time points in said operational cycle of said internal combustion engine and said fuel injection valve which are proper fuel injection time points, performing the following processes in the specified order:

(d2.1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

(d2.2) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse;

(d2.3) calculating, from the current value of said sixth quantity representing the actual fuel amount to be injected through said fuel injection valve in the next fuel injection pulse and the current value of said second quantity representing the proportion of fuel in one pulse of fuel injected through aid fuel injection valve which will adhere to said walls of said air-fuel mixture intake system, the value of a seventh quantity representing the amount of fuel from the next fuel injection pulse that will adhere to said walls of said air-fuel mixture intake system;

(d2.4) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and (d2.5) outputting to said interface device a fuel injection valve control electrical signal, based upon the value of said sixth quantity representing the actual fuel amount to be injected through said fuel injection valve in the next fuel injection pulse, such as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold;

wherein the method used by said electronic computer in subprocess (d2.2) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

11. For an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle:

an engine control device, comprising:

(a) a plurality of sensors, which sense the current values of certain operational parameters of said internal combustion engine;

(b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine;

(d) said electronic computer repeatedly and alternatingly and/or simultaneously:

(d1) based upon the current values of said sensed operational parameters of said internal combustion engine, calculating the value of a first quantity representing the desired amount of fuel to be provided to said combustion chamber system of said internal combustion engine during the time period between the next two fuel injection pulse time points, the value of a second quantity representing the proportion of fuel in one pulse of fuel injected through said fuel injection valve which will adhere to said walls of said air-fuel mixture intake system, and the value of a third quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d2) at time points in said operational cycle of said internal combustion engine and said fuel injection valve which are proper fuel injection time points, performing the following processes in the specified order:

(d2.1) calculating, from the current value of a fourth quantity representing the total amount of fuel adhering to said walls of said air-fuel mixture intake system, and the current value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

and, if according to the current operational conditions of said internal combustion engine it is proper to inject fuel through said fuel injection valve, (d2.2) performing the following processes in the specified order:

(d2.2.1) calculating, from the current value of said first quantity representing the desired amount of fuel to be provided to said combustion chamber system of said internal combustion engine during the time period between the next two fuel injection pulse time points, from the current value of said second quantity representing the proportion of fuel in one pulse of fuel injected through said fuel injection valve which will adhere to said walls of said air-fuel mixture intake system, and from the current value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a sixth quantity representing the actual fuel amount to be injected through said fuel injection valve in the next fuel injection pulse;

(d2.2.2) calculating, from the current value of said sixth quantity representing the actual fuel amount to be injected through said fuel injection valve in the next fuel injection pulse and the current value of said second quantity representing the proportion of fuel in one pulse of fuel injected through said fuel injection valve which will adhere to said walls of said air-fuel mixture intake system, the value of a seventh quantity representing the amount of fuel from the next fuel injection pulse that will adhere to said walls of said air-fuel mixture intake system;

(d2.2.3) updating the value of said fourth quantity representing the total amount of fuel adhering to said walls of said air-fuel mixture intake system by adding thereto the value of said seventh quantity representing the amount of fuel from the next fuel injection pulse that will adhere to said walls of said air-fuel mixture intake system and by subtracting from the result of this addition the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

(d2.2.4) modifying said actuating signal according to the value of said sixth quantity representing the actual fuel amount to be injected through said fuel injection valve in the next fuel injection pulse; and (d2.2.5) outputting to said interface device a fuel injection valve control electrical signal, based upon the value of said sixth quantity representing the actual fuel amount to be injected through said fuel injection valve in the next fuel injection pulse, such as to cause said fuel injection valve to open for a time period which will allow an amount of fuel approximately equal to the fuel amount represented by said sixth quantity representing the actual fuel amount to be injected through said fuel injection valve in the next fuel injection pulse to pass through said fuel injection valve so as to be injected into said intake manifold;

but otherwise, if according to the current operational conditions of said internal combustion engine it is not proper to inject fuel through said fuel injection valve, (d2.3) performing the following process:

(d2.3.1) updating the value of said fourth quantity representing the total amount of fuel adhering to said walls of said air-fuel mixture intake system by subtracting therefrom the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it;

wherein the method used by said electronic computer in subprocess (d2.2.1) for calculating the value of said sixth quantity representing the actual fuel amount to be injected through said fuel injection valve in the next fuel injection pulse is such that the sum of the value of said sixth quantity representing the actual fuel amount to be injected through said fuel injection valve in the next fuel injection pulse and the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said seventh quantity representing the amount of fuel from the next fuel injection pulse that will adhere to said walls of said air-fuel mixture intake system is approximately equal to the value of said first quantity representing the desired amount of fuel to be provided to said combustion chamber system of said internal combustion engine during the time period between the next two fuel injection pulse time points.

12. An engine control device according to either one of claims 10 and 11, wherein the method used by said electronic computer for calculating the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fourth quantity representing the total amount of fuel adhering to said walls of said air-fuel mixture intake system by the value of said third quantity representing the proportion of the total amount of fuel adhering to said walls of said air-fuel mixture intake system which is sucked off therefrom to pass into said combustion chamber system of said internal combustion engine during the time interval between two successive fuel injection pulses.

13. An engine control device according to either one of claims 10 and 11, wherein the method used by said electronic computer for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

14. An engine control device according to claim 12, wherein the method used by said electronic computer for calculating the value of said sixth quantity representing the actual fuel amount to be injected through said fuel injection valve in the next fuel injection pulse is to subtract from the value of said first quantity representing the desired amount of fuel to be provided to said combustion chamber system of said internal combustion engine during the time period between the next two fuel injection pulse time points the value of said fifth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said second quantity representing the proportion of fuel in one pulse of fuel injected through said fuel injection valve which will adhere to said walls of said air-fuel mixture intake system.

15. An engine control device according to either one of claims 10 and 11, wherein the method used by said electronic computer for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

16. An engine control device according to claim 12, wherein the method used by said electronic computer for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

17. An engine control device according to claim 13, wherein the method used by said electronic computer for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

18. An engine control device according to claim 14, wherein the method used by said electronic computer for calculating the value of said seventh quantity representing the amount of fuel from the next fuel injection pulse that will adhere to said walls of said air-fuel mixture intake system is to multiply the value of said sixth quantity representing the actual fuel amount to be injected through said fuel injection valve in the next fuel injection pulse by the value of said second quantity representing the proportion of fuel in one pulse of fuel injected through said fuel injection valve which will adhere to said walls of said air-fuel mixture intake system.

* * * * *